US009677819B2

(12) United States Patent
Lee et al.

(10) Patent No.: US 9,677,819 B2
(45) Date of Patent: Jun. 13, 2017

(54) AIR CONDITIONER AND HEAT EXCHANGER THEREFOR

(71) Applicants: Juseok Lee, Changwon-si (KR); Byeonghwi Lee, Changwon-si (KR); Jungwook Moon, Changwon-si (KR); Jeonggyu Kim, Changwon-si (KR)

(72) Inventors: Juseok Lee, Changwon-si (KR); Byeonghwi Lee, Changwon-si (KR); Jungwook Moon, Changwon-si (KR); Jeonggyu Kim, Changwon-si (KR)

(73) Assignee: LG ELECTRONICS INC., Seoul (KR)

( * ) Notice: Subject to any disclaimer, the term of this patent is extended or adjusted under 35 U.S.C. 154(b) by 679 days.

(21) Appl. No.: 14/089,951

(22) Filed: Nov. 26, 2013

(65) Prior Publication Data

US 2014/0216699 A1 Aug. 7, 2014

(30) Foreign Application Priority Data

Feb. 1, 2013 (KR) ..... 10-2013-0011836
Feb. 1, 2013 (KR) ..... 10-2013-0011837
(Continued)

(51) Int. Cl.
*F28D 15/00* (2006.01)
*F28D 7/02* (2006.01)
(Continued)

(52) U.S. Cl.
CPC ..... *F28D 15/00* (2013.01); *F25B 39/00* (2013.01); *F28D 7/024* (2013.01); *F28D 7/12* (2013.01);
(Continued)

(58) Field of Classification Search
CPC .. F28D 7/04; F28D 1/0472; F28D 2001/0266; F28D 15/00; F28D 7/024;
(Continued)

(56) References Cited

U.S. PATENT DOCUMENTS 1,343,669 A * 6/1920 Funderburk ..... F28D 7/024 165/163
1,526,320 A 2/1925 Cook
(Continued)

FOREIGN PATENT DOCUMENTS

DE 1 078 145 3/1960
DE 1078145 B * 3/1960 ..... F28D 7/024
(Continued)

OTHER PUBLICATIONS

U.S. Office Action issued in co-pending U.S. Appl. No. 13/895,542 dated Jul. 11, 2016.
(Continued)

*Primary Examiner* — Tho V Duong
(74) *Attorney, Agent, or Firm* — KED & Associates, LLP

(57) ABSTRACT

An air conditioner and a heat exchanger therefor are provided. The heat exchanger may include a shell; an injection pipe to guide a heat source fluid to an inside of the shell; a first refrigerant tube formed with a first spiral tube; a second refrigerant tube formed with a second spiral tube having a radius larger than a radius of the first spiral tube; and a discharge pipe to which the heat source fluid heat-exchanged with a refrigerant is discharged. The first refrigerant tube and the second refrigerant tube may be connected in parallel, and the second spiral tube may have a larger pitch between turns and a smaller number of turns than the first spiral tube. The heat exchanger may provide a simple structure and a high heat-exchange performance.

27 Claims, 21 Drawing Sheets

(30) Foreign Application Priority Data

Feb. 1, 2013 (KR) ..... 10-2013-0011838
Feb. 1, 2013 (KR) ..... 10-2013-0011839

(51) Int. Cl.

| | |
|---|---|
| ***F28D 7/12*** | (2006.01) |
| ***F28F 1/26*** | (2006.01) |
| ***F25B 39/00*** | (2006.01) |
| ***F28F 1/34*** | (2006.01) |
| *F25B 30/02* | (2006.01) |
| *F28F 9/02* | (2006.01) |
| *F28F 9/22* | (2006.01) |
| *F28D 21/00* | (2006.01) |

(52) U.S. Cl.
CPC ..... *F28F 1/26* (2013.01); *F28F 1/34* (2013.01); *F28F 9/027* (2013.01); *F28F 9/0275* (2013.01); *F25B 30/02* (2013.01); *F25B 2339/046* (2013.01); *F25B 2339/047* (2013.01); *F28D 2021/0068* (2013.01); *F28F 9/0256* (2013.01); *F28F 9/22* (2013.01); *F28F 2235/00* (2013.01)

(58) Field of Classification Search
CPC .... F28D 7/12; F28D 2021/0068; F25B 39/00; F25B 2339/046; F25B 2339/047; F25B 30/02; F28F 1/26; F28F 1/34; F28F 9/0275; F28F 9/027; F28F 9/22; F28F 2235/00
USPC ..... 165/163
See application file for complete search history.

(56) References Cited

U.S. PATENT DOCUMENTS

| | | | | |
|---|---|---|---|---|
| 2,566,976 | A | 9/1931 | Bernstrom | |
| 1,840,940 | A | 1/1932 | Ecabert | |
| 1,940,964 | A | 12/1933 | McIntyre | |
| 2,125,972 | A | 8/1938 | Wilson | |
| 2,534,690 | A | 12/1950 | Young, Jr. | |
| 2,761,430 | A | 9/1956 | Schaefer | |
| 2,805,048 | A | 9/1957 | Angelery | |
| 2,288,251 | A | 5/1959 | Algot | |
| 3,199,583 | A | 8/1965 | Hood, Jr. et al. | |
| 3,332,477 | A * | 7/1967 | Saunders | F24D 3/082 165/163 |
| 3,341,122 | A | 9/1967 | Whittell, Jr. | |
| 3,817,688 | A | 6/1974 | Shadley | |
| 4,152,015 | A | 5/1979 | Jones et al. | |
| 4,202,406 | A | 5/1980 | Avery | |
| 4,313,491 | A | 2/1982 | Molitor | |
| 4,471,836 | A | 9/1984 | Hokanson | 165/111 |
| 4,570,452 | A * | 2/1986 | Bingham | F24J 3/081 165/146 |
| 4,893,672 | A | 1/1990 | Bader | |
| 5,046,548 | A * | 9/1991 | Tilly | B01F 5/061 165/140 |
| 5,379,832 | A | 1/1995 | Dempsey | |
| 6,095,240 | A | 8/2000 | Hassanein et al. | |
| 6,102,106 | A | 8/2000 | Manning et al. | |
| 7,458,222 | B2 | 12/2008 | Orr | |
| 7,549,462 | B2 | 6/2009 | Nuris et al. | |
| 7,669,644 | B2 * | 3/2010 | Alessandrini | F24H 1/43 165/162 |
| 9,389,026 | B2 * | 7/2016 | Hwang | F28F 1/00 |
| 2006/0005955 | A1 | 1/2006 | Orr | |
| 2009/0025399 | A1 | 1/2009 | Kamen | |
| 2010/0017952 | A1 | 1/2010 | Thweatt, Jr. | |

FOREIGN PATENT DOCUMENTS

| | | | | |
|---|---|---|---|---|
| DE | 1 952 861 | | 4/1971 | |
| DE | 1679737 | A1 * | 5/1971 | F24D 3/082 |
| DE | 1 679 733 | | 1/1972 | |
| DE | 8715522 | U1 | 5/1988 | |
| DE | 10 2007 002 051 | | 7/2007 | |
| EP | 0 261 005 | | 3/1988 | |
| EP | 0 819 892 | A2 | 1/1998 | |
| EP | 0 845 640 | | 6/1998 | |
| EP | 0 845 640 | A1 | 6/1998 | |
| EP | 1 750 070 | | 2/2007 | |
| EP | 1 813 882 | | 8/2007 | |
| EP | 2 505 932 | A1 | 10/2012 | |
| FR | 2155770 | A1 * | 5/1973 | F28D 7/022 |
| GB | 152276 | A | 10/1920 | |
| GB | 811665 | A | 4/1959 | |
| GB | 1387571 | A | 3/1975 | |
| JP | 6-84167 | | 12/1994 | |
| JP | 2000-055574 | | 2/2000 | |
| JP | 2002-195767 | | 7/2002 | |
| JP | 2004-144366 | A | 5/2004 | |
| JP | 2007-278688 | A | 10/2007 | |
| JP | 2007-333319 | A | 12/2007 | |
| JP | 2012-072936 | | 4/2012 | |
| KR | 10-1999-0076959 | A | 10/1999 | |
| KR | 10-2001-0029372 | A | 4/2001 | |
| KR | 10-0353334 | | 2/2003 | |
| KR | 10-2004-0111678 | A | 12/2004 | |
| KR | 10-2007-0094792 | A | 9/2007 | |
| KR | 10-2009-0095253 | | 9/2009 | |
| KR | 10-2011-0088913 | A | 8/2011 | |
| KR | 10-2011-0128709 | | 11/2011 | |
| WO | WO 88/01362 | | 2/1988 | |
| WO | WO 03/023306 | | 3/2003 | |
| WO | WO 03/087677 | | 10/2003 | |
| WO | WO 2006/105605 | A1 | 10/2006 | |

OTHER PUBLICATIONS

Korean Office Action dated Mar. 10, 2016 issued in Application No. 10-2012-0068752.
U.S. Appl. No. 13/887,728, filed May 6, 2013.
U.S. Appl. No. 13/890,405, filed May 9, 2013.
U.S. Appl. No. 13/895,542, filed May 16, 2013.
European Search Report dated Nov. 21, 2014. (Full English Text).
Korean Office Action dated Dec. 26, 2014.
European Search Report dated Dec. 11, 2014. (Full English Text).
U.S. Notice of Allowance dated Oct. 7, 2015 issued in co-pending U.S. Appl. No. 13/887,728.
U.S. Office Action dated Nov. 23, 2015 issued in co-pending U.S. Appl. No. 13/890,405.
European Search Report dated Sep. 24, 2013.
Korean Office Action dated Aug. 30, 2013.
U .S . Office Action dated Jun. 4, 2015 issued in co-pending U.S. Appl. No. 13/895,542.
U.S. Office Action dated Jun. 12, 2015 issued in co-pending U.S. Appl. No. 13/887,728.
European Search Report dated May 13, 2014 issued in Application No. 14 151 438.0.
European Search Report dated May 13, 2014 issued in Application No. 13 193 106.5.
Korean Office Action dated May 30, 2014 issued in Application No. 10-2013-0011836.
Korean Office Action dated May 30, 2014 issued in Application No. 10-2013-0011837.
Korean Office Action dated May 30, 2014 issued in Application No. 10-2013-0011838.
Korean Office Action dated May 30, 2014 issued in Application No. 10-2013-0011839.

* cited by examiner

AIR CONDITIONER AND HEAT EXCHANGER THEREFOR

CROSS-REFERENCE TO RELATED APPLICATION(S)

This application claims priority to Korean Application Nos. 2013-11836, 2013-11837, 2013-11838, and 2013-11839 filed in Korea on Feb. 1, 2013, whose entire disclosures are hereby incorporated by reference.

BACKGROUND

1. Field

An air conditioner and a heat exchanger therefor are disclosed herein.

2. Background

Air conditioners and heat exchangers therefor are known. However, they suffer from various disadvantages.

BRIEF DESCRIPTION OF THE DRAWINGS

Embodiments will be described in detail with reference to the following drawings in which like reference numerals refer to like elements, and wherein.

DETAILED DESCRIPTION

Figure 1:
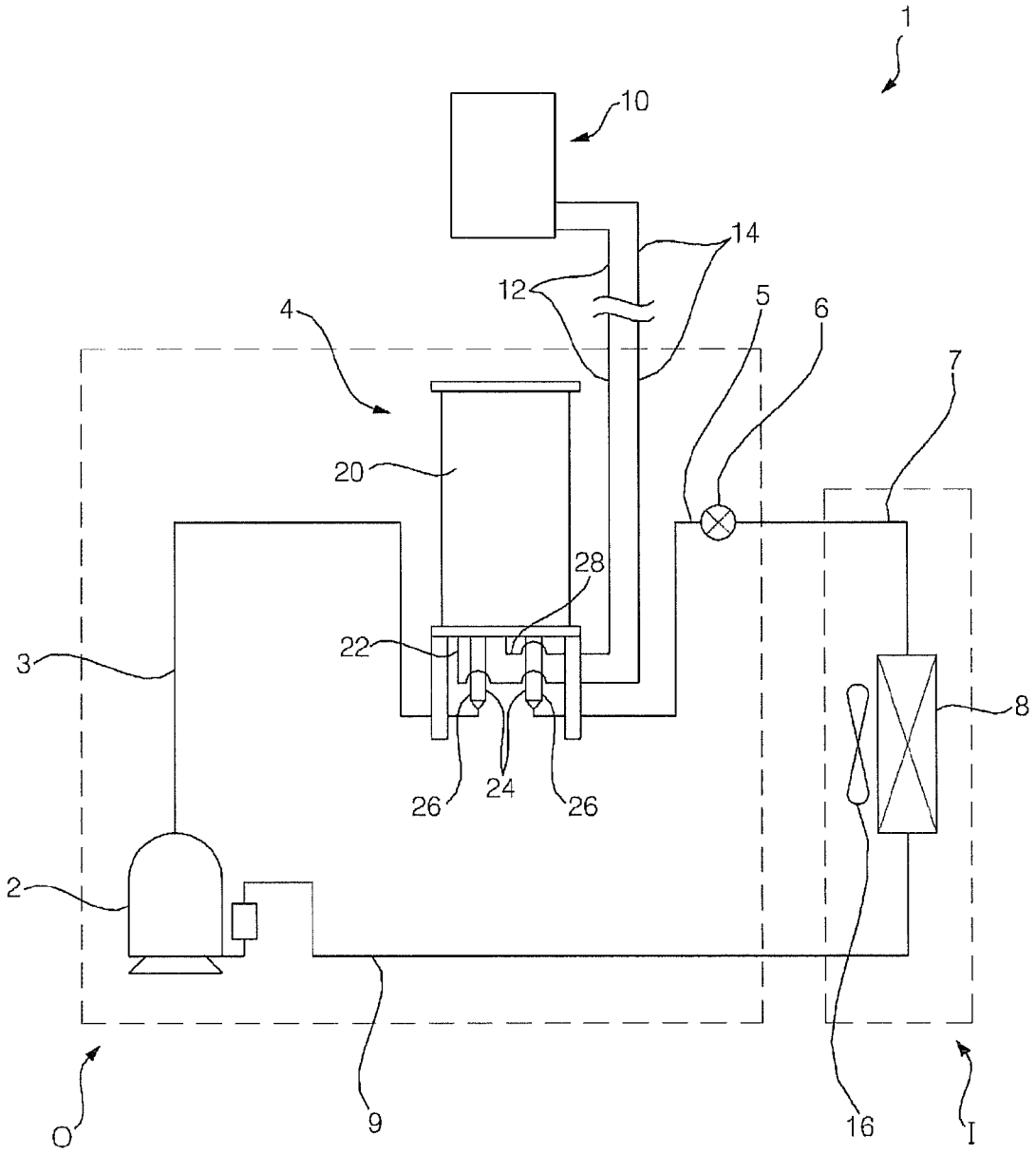
FIG. 1 is a schematic diagram of an air conditioner having a heat exchanger according to an embodiment.

Embodiments will be described in detail with reference to the accompanying drawings. Where possible, like reference numerals have been used to indicate like elements and repetitive disclosure has been omitted.

In general, a heat exchanger is a device that exchanges heat between two fluids and is widely used in air-conditioning, and heating and cooling. Such a heat exchanger may function as a waste heat collection exchanger that collects waste heat, as a cooler that cools a fluid at a high temperature side, as a heater that heats a fluid at a low temperature side, as a condenser that condenses steam, or as evaporator that evaporates a fluid at a low temperature side.

There are various types of heat exchangers, such as fin tube type heat exchangers having a tube that passes a first fluid therethrough and a fin installed on the tube that heat-exchanges a first fluid with a second fluid surrounding the tube and the fin; a shell tube type air conditioner including a shell to receive passed therethrough a first fluid, and a tube to receive passed therethrough a second fluid to heat-exchange with the first fluid; a double tube heat exchanger having an inner tube to pass therethrough a first fluid and an outer tube to pass therethrough a second fluid to heat-exchange with the first fluid and that surrounds the inner tube; and a plate type heat exchanger having a heat transfer plate to receive passed thereby a first fluid and a second fluid. Among such heat exchangers, the shell tube type heat exchanger may include a tube, which may be spirally formed, that heat-exchanges with the first fluid and the second fluid in an inside of a shell. The first fluid may be introduced into the inside of the shell, and may heat or cool the second fluid while passing through the inside of the shell. The second fluid may be heat-exchanged with the first fluid while passing through the tube.

FIG. 1 is a schematic diagram of an air conditioner having a heat exchanger according to an embodiment. As shown in FIG. 1, the air conditioner 1 may include a compressor 2, a first heat exchanger 4, an expansion mechanism 6, and a second heat exchanger 8. The first heat exchanger 4 may heat-exchange a refrigerant with a heat source fluid, such as water. The heat source fluid may function as a cooling fluid to suction heat of a refrigerant and function as a heating fluid to apply heat to the refrigerant. The air conditioner 1 may include the compressor 2, in which the refrigerant is compressed, the first heat exchanger 4 in which the refrigerant is heat-exchanged with the heat source fluid, the expansion mechanism 6 in which the refrigerant is expanded, and the second heat exchanger 8 in which the refrigerant is heat-exchanged with air.

The refrigerant may be passed through the compressor 2, the first heat exchanger 4, the expansion mechanism 6, and the second heat exchanger 8 in order. In other words, the refrigerant compressed in the compressor 2 may be sequentially passed through the first heat exchanger 4, the expansion mechanism 6, and the second heat exchanger 8, and may then be returned to the compressor 2. In such a case, the first heat exchanger 4 may function as a condenser to condense the refrigerant, the second heat exchanger 8 may function as an evaporator to evaporate the refrigerant, and the heat source fluid may function as a cooling fluid to suction the heat of the refrigerant compressed in the compressor 2.

Also, the refrigerant may be passed through the compressor 2, the second heat exchanger 8, the expansion mechanism 6, and the first heat exchanger 4, in order. In order words, the refrigerant compressed in the compressor 2 may be passed sequentially through the second heat exchanger 8, the expansion mechanism 6, and the first heat exchanger 4, and may then be returned to the compressor 2. In such a case, the second heat exchanger 8 may function as a condenser to condense the refrigerant, the first heat exchanger 4 may function as an evaporator to evaporate the refrigerant, and the heat source fluid may function as a heating fluid to heat-discharge into the refrigerant passing through the first heat exchanger 4.

The air conditioner 1 may be configured as a heat pump. That is, the air conditioner may include the compressor 2, in which the refrigerant is compressed, the first heat exchanger 4, in which the refrigerant is heat-exchanged with the heat source fluid, the expansion mechanism 6, in which the refrigerant is expanded, and the second heat exchanger 8, in which the refrigerant is heat-exchanged with indoor air. In addition, the air conditioner 1 may further include a flow path switching valve (not shown) by which the refrigerant compressed in the compressor 2 may be selectively sent or directed to the first heat exchanger 4 or the second heat exchanger 8. The air conditioner 1 may also include a first circulating flow path and a second circulating flow path according to a flow direction of the refrigerant.

In the first circulating flow path, the refrigerant compressed in the compressor 2 may be sequentially passed through the flow path switching valve, the first heat exchanger 4, the expansion mechanism 6, the second heat exchanger 8, and the flow path switching valve and may then be returned to the compressor 2. The first circulating circuit may be a flow path for a cooling operation by which indoor air may be cooled by the second heat exchanger 8, the first heat exchanger 4 may function as a condenser to condense the refrigerant, and the second heat exchanger 8 may function as an evaporator to evaporate the refrigerant.

In the second circulating flow path, the refrigerant compressed in the compressor 2 may be sequentially passed through the flow path switching valve (not shown), the second heat exchanger 8, the expansion mechanism 6, the first heat exchanger 4, and the flow path switching valve and then may be returned to the compressor 2. The second circulating flow path may be a flow path for a heating operation by which indoor air may be heated by the second heat exchanger 8, the second heat exchanger 8 may function as a condenser to condense the refrigerant, and the first heat exchanger 4 may function as an evaporator to evaporate the refrigerant.

The heat source fluid may be, for example, water or an antifreezing solution. The refrigerant may be one of various refrigerants, such as a Freon-based refrigerant typically used in air conditioners or a carbon dioxide refrigerant.

The compressor 2 may be one of various compressors, such as a rotary compressor, a scroll compressor, or a screw compressor, for example. The compressor 2 may be connected to the first heat exchanger 4 and a compressor outlet flow path 3.

The first heat exchanger 4 may be, for example, a shell tube type heat exchanger. The first heat exchanger 4 may include a shell 20, through which a heat source fluid, such as water or an antifreezing solution, may pass, and refrigerant tubes 24 and 26 through which the refrigerant may pass. The first heat exchanger 4 may be connected to the expansion mechanism 6 and a first heat exchanger-expansion mechanism connecting flow path 5. The first heat exchanger 4 will be described in detail hereinbelow.

The expansion mechanism 6 may be, for example, a capillary tube or an electronic expansion valve to expand the refrigerant. The expansion mechanism 6 may be connected to the second heat exchanger 8 and an expansion mechanism-second heat exchanger connecting flow path 7.

The second heat exchanger 8 may be, for example, a fin tube type heat exchanger or a coil type heat exchanger, through which the refrigerant may pass. The second heat exchanger 8 may include a refrigerant tube heat-exchanged with indoor air while passing the refrigerant therethrough. If the second heat exchanger 8 is a fin tube type heat exchanger, it may further include a fin as a heat transfer member coupled with the refrigerant tube. The second heat exchanger 8 may be connected to the compressor 2 and a compressor suction flow path 9.

The air conditioner 1 may further include a heat treatment device 10 connected with the first heat exchanger 4. If the first heat exchanger 4 functions as a condenser to condense the refrigerant, the heat treatment device 10 may be a cooler to cool the heat source fluid. If the first heat exchanger 4 functions as an evaporator to evaporate the refrigerant, the heat treatment device 10 may be heater to heat the heat source fluid. The heat treatment device 10 may include a cooling tower to cool the heat source fluid. The heat treatment device 10 may be connected to the first heat exchanger 4 via outlet pipe 12 and inlet pipe 14. The first heat exchanger 4 may be connected to the heat treatment device 10 via the outlet pipe 12, and the heat source fluid of the first heat exchanger 4 may be output to the heat treatment device 10 through the outlet pipe 12. The first heat exchanger 4 may be connected to the heat treatment device 10 via the inlet pipe 14, and the heat source fluid of the heat treatment device 10 may be input to the first heat exchanger 4 through the inlet pipe 14. A circulation mechanism, such as a pump, to circulate heat source fluid to the heat treatment device 10 and the first heat exchanger 4 may be installed in at least one of the heat treatment device 10, the outlet pipe 12, or the inlet pipe 14.

The air conditioner 1 may further include an indoor fan 16 by which indoor air may flow to the second heat exchanger 8 and then be discharged again into an indoor space.

The compressor 2, the first heat exchanger 4, the expansion mechanism 6, the second heat exchanger 8, and the indoor fan 16 may be installed in one air conditioning device. In addition, as the indoor air flows to the second heat exchanger 8 through, for example, a duct and then is discharged again into the indoor space through the duct, it is possible that the indoor space may be cooled and heated. The heat treatment device 10 may be installed in other than one air conditioning device, and may be connected to the one air conditioning device and the outlet pipe 12 and the inlet pipe 14.

The compressor 2, the first heat exchanger 4, the expansion mechanism 6, the second heat exchanger 8, and the indoor fan 16 may be separately installed in a plurality of air conditioning devices I and O. The first heat exchanger 4 and the indoor fan 16 may be installed in an indoor device I together, and the compressor 2 and the first heat exchanger 4 may be installed together in a compression device O (or an outdoor device). The expansion mechanism 6 may be installed in at least one of the indoor device I or the compression device O. One expansion mechanism 6 may be installed in the indoor device I or the compression device O.

Alternatively, expansion mechanism 6 may be installed in the indoor device I, and a second expansion mechanism may be installed in the compression device O. The first expansion mechanism may function as an outdoor expansion mechanism positioned closer to the first heat exchanger 4 than the second heat exchanger 8. The second expansion mechanism may function as an indoor expansion mechanism positioned closer to the second heat exchanger 8 than the first heat exchanger 4. The indoor device I may be installed in the indoor space which is to be cooled or heated. The compression device O may be installed in a machine room, a basement, or a rooftop of a building, for example. The compression device O may be connected to the outlet pipe 12 and the inlet pipe 14 of the heat treatment device 10.

Figure 2:
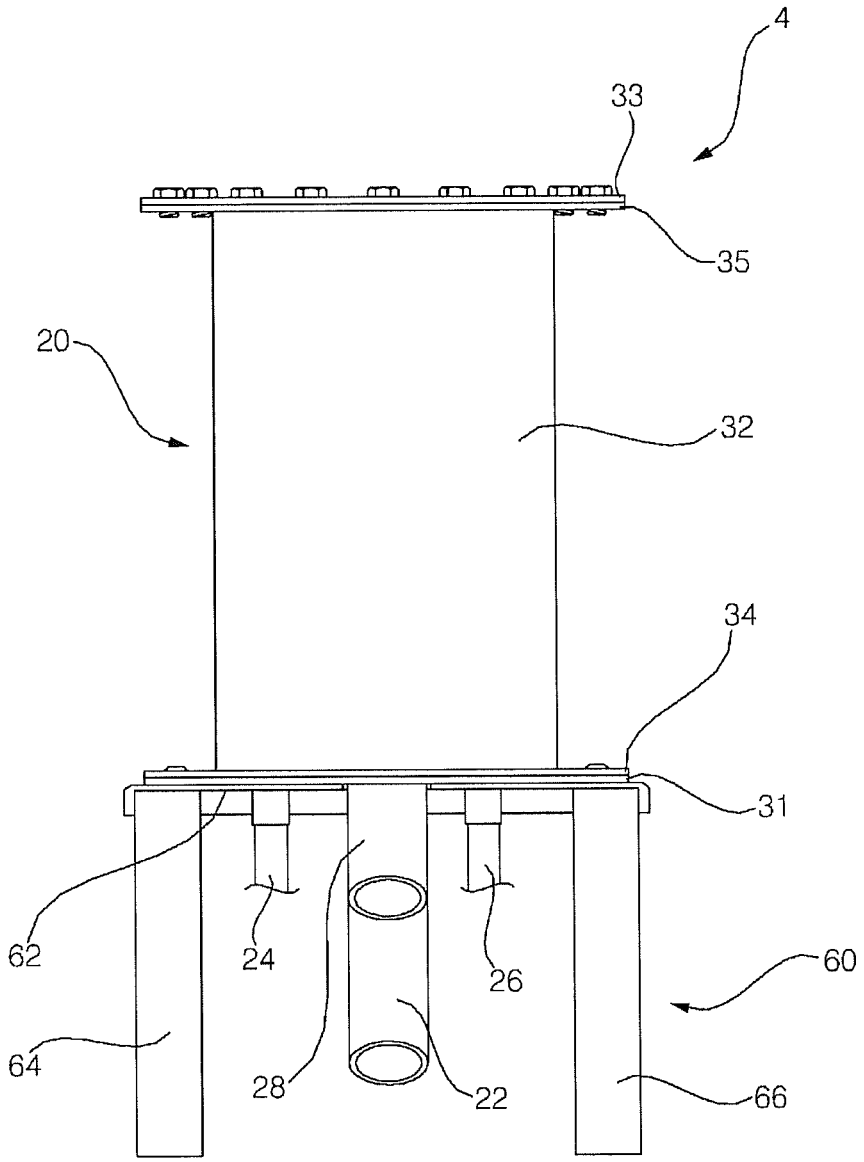
FIG. 2 is a schematic side view of a heat exchanger according to an embodiment.
Figure 3:
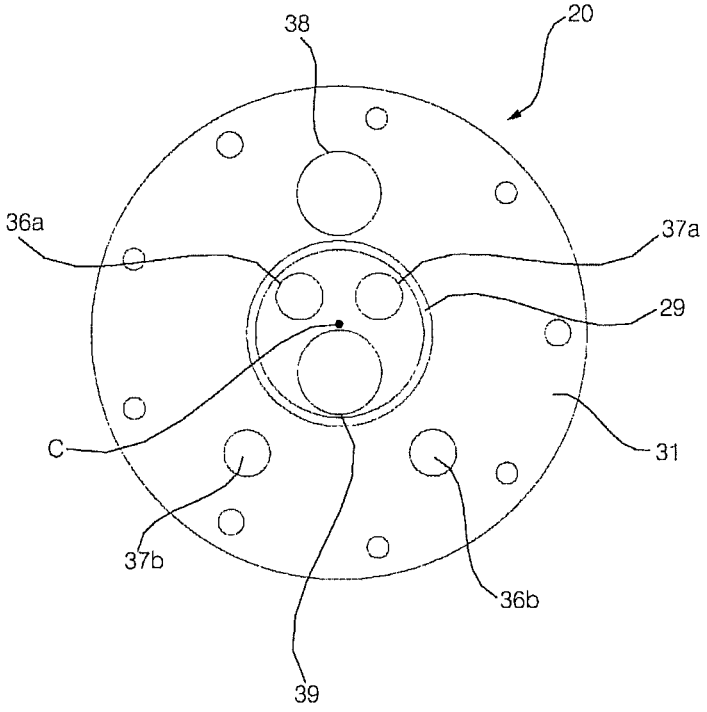
FIG. 3 is a schematic top view of a shell lower plate of the heat exchanger of FIG. 2.
Figure 4:
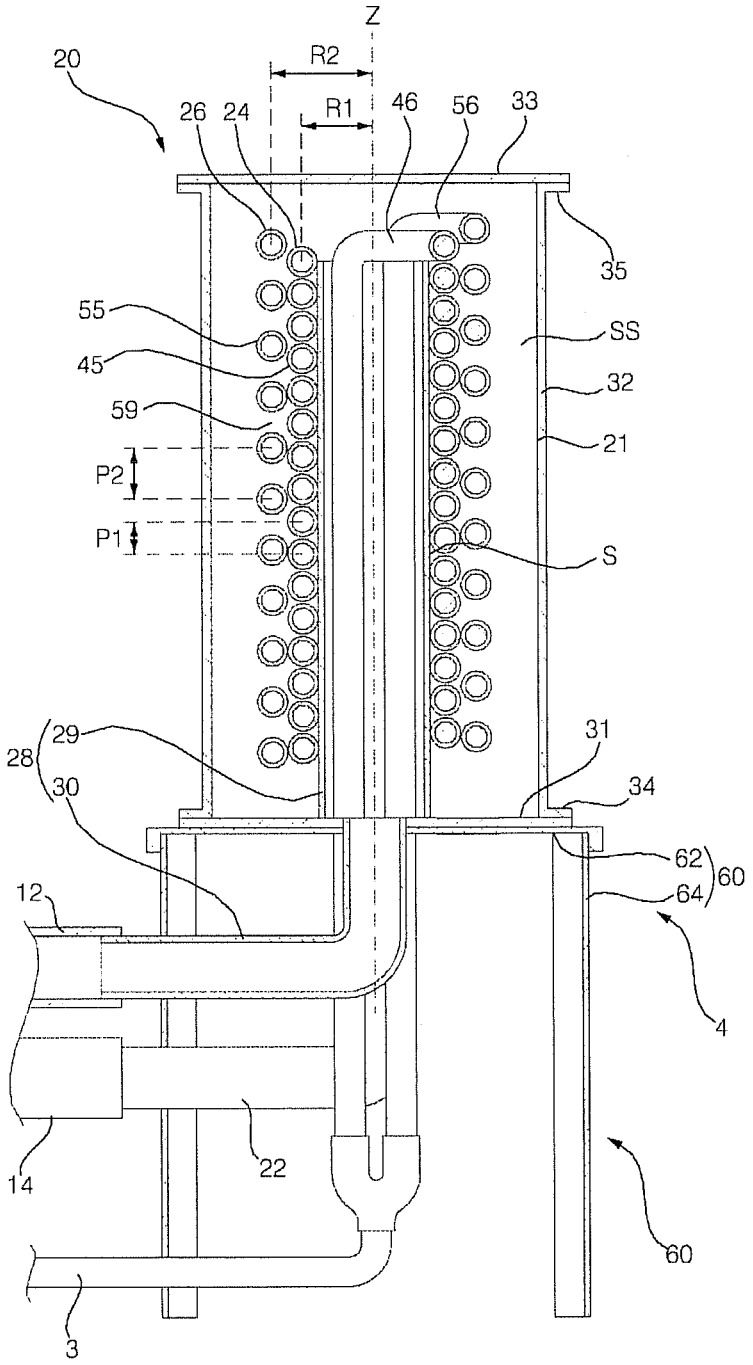
FIG. 4 is a schematic longitudinal cross-sectional view of the heat exchanger of FIG. 2.
Figure 5:
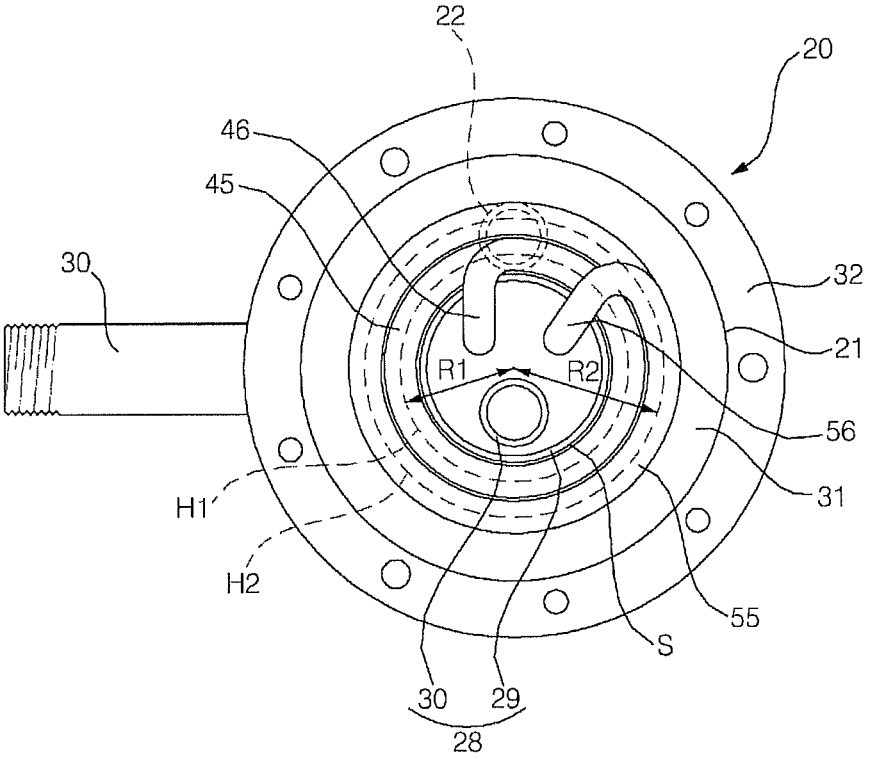
FIG. 5 is a schematic top view of the heat exchanger of FIG. 2.
Figure 6:
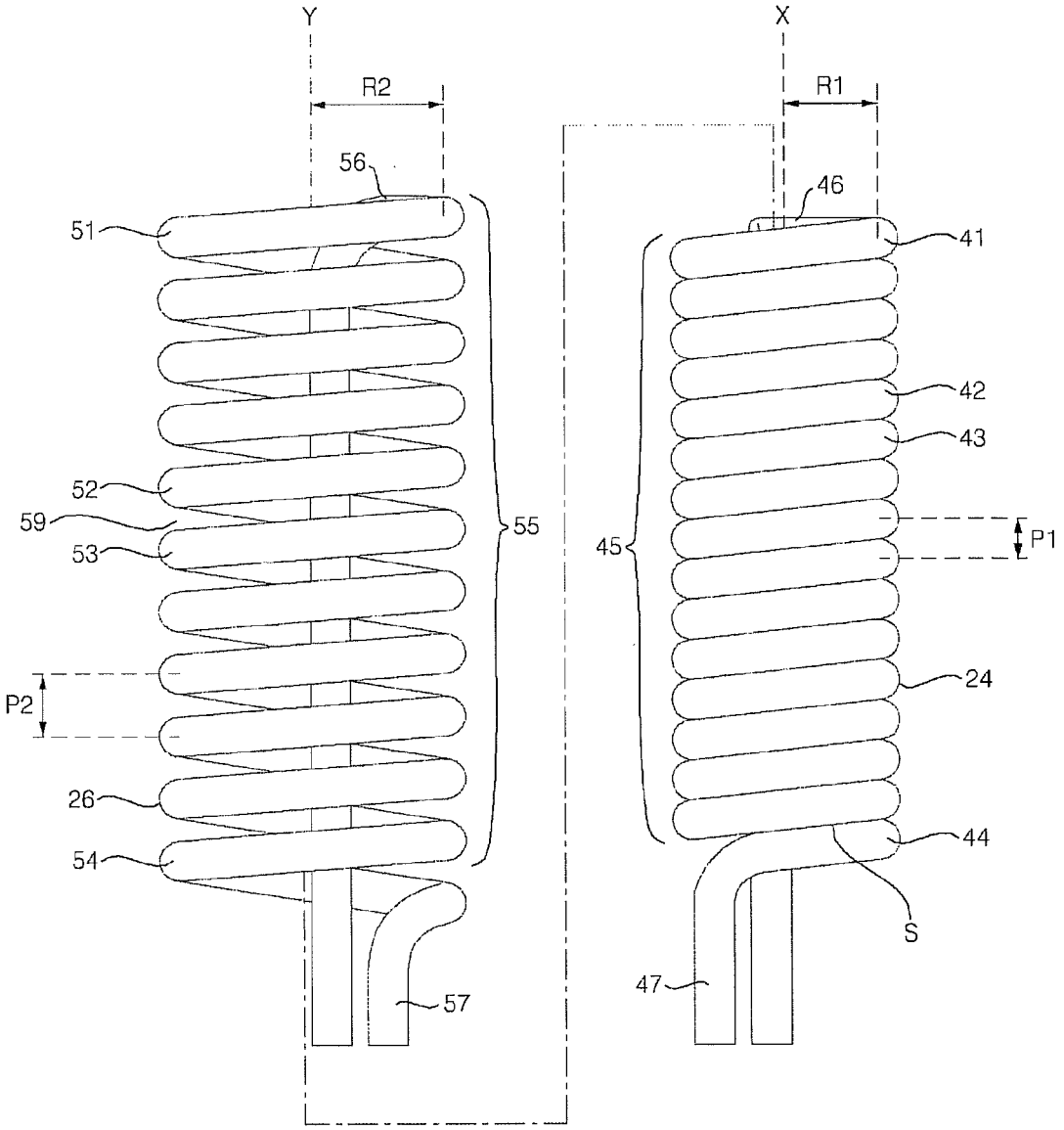
FIG. 6 is a schematic exploded perspective view of a plurality of refrigerant tubes of the heat exchanger of FIG. 2.

Hereinafter, the first heat exchanger 4, which may be referred to as the heat exchanger, will be described. FIG. 2 is a schematic side view of a heat exchanger according to an embodiment. FIG. 3 is a schematic top view of a shell lower plate of the heat exchanger of FIG. 2. FIG. 4 is a schematic longitudinal cross-sectional view of the heat exchanger of FIG. 2. FIG. 5 is a schematic top view of the heat exchanger of FIG. 2. FIG. 6 is a schematic exploded perspective view of a plurality of refrigerant tubes of the heat exchanger of FIG. 2.

The heat exchanger 4 may include a shell 20, at least one injection pipe 22 that guides the heat source fluid to an inside of the shell 20, a refrigerant tube, through which a refrigerant may pass, and a discharge pipe 28 that discharges the heat source fluid to heat-exchange the refrigerant. The heat source fluid may be introduced into the inside of the shell 20 through the injection pipe 22, may be heat-exchanged with the refrigerant tube in the shell 20, and may be discharged outside of the heat exchanger 4 through the discharge pipe 28. The refrigerant may be heat-exchanged with the heat source fluid in the shell 20 while passing through the refrigerant tube. If the refrigerant has a lower temperature than the heat source fluid in the shell 20, it may be evaporated while suctioning the heat of the heat source fluid. If the refrigerant has a higher temperature than the heat source fluid in the shell 20, it may be condensed while discharging the heat of the heat source fluid. One refrigerant tube may be installed in the shell 20, or a plurality of refrigerant tubes may be installed in the one shell 20. In the embodiment of FIG. 2, the heat exchanger 4 includes a plurality of refrigerant tubes 24, 26, and the refrigerant may be heat-exchanged with the heat source fluid in each of the plurality of refrigerant tubes 24, 26.

The shell 20 may be formed to have an inner space S inside thereof. The shell 20 may extend in a substantially vertical direction. The shell 20 may include a lower plate 31, and a hollow shell 32 disposed at an upper side of the lower plate 31. The shell 20 may further include an upper plate 33 disposed at an upper side of the hollow shell 32. The hollow shell 32 may have a hollow cylinder shape or a hollow polygonal cylinder shape, for example. A lower flange 34 may be formed at a lower portion of the hollow shell 32. The lower flange 34 may be coupled with the lower plate 31 by, for example, a fastening member, such as a bolt and a nut. An upper flange 35 may be formed at an upper portion of the hollow shell 32. The upper flange 35 may be coupled with the upper plate 33 by, for example, a fastening member, such as a bolt and a nut.

As set forth above, the hollow shell 32 may be formed with a space inside thereof. The lower plate 31 may block an opening aperture of the hollow shell 32, and the upper plate 32 may block an upper opening of the hollow shell 32.

A plurality of refrigerant tube penetration holes 36*a*, 36*b*, 37*a* and 37*b* may be formed in the shell 20, through which the refrigerant tubes 24 and 26 may penetrate or pass. Two refrigerator tube penetration holes may be formed in the shell 20 per one refrigerant tube. If the heat exchanger 4 includes two refrigerant tubes 24 and 26, four refrigerant tube penetration holes 36*a*, 36*b*, 37*a* and 37*b* may be formed. An injection pipe penetration hole 38 may be formed in the shell 20, through which the injection pipe 22 may penetrate or pass. A discharge pipe connection hole 39 may be formed in the shell 20, through which the discharge pipe 28 may pass and be connected thereto. The injection pipe 22, the plurality of refrigerant tubes 24 and 26, and the discharge pipe 28 may penetrate together any one of the lower plate 31, the hollow shell 32, or the upper plate 33. In this embodiment, the refrigerant tube penetration holes 36*a*, 36*b*, 37*a* and 37*b*, the injection pipe penetration hole 38, and the discharge pipe connection hole 39 are formed in the lower plate 31.

One end of the injection pipe 22 may be located on or outside of the shell 20, and a second end of the injection pipe 22 may be disposed in the shell 20. The second end located of the injection pipe 22 in the shell 20 may be located on or at at least one side of the plurality of refrigerant tubes 24 and 26. Further, the second end of the injection pipe 22 may be installed to be opposed to at least one of the refrigerant tube 24 or the refrigerant tube 26.

Each of the plurality of refrigerant tubes 24, 26 may include a spiral tube or spiral tube portion located in the shell 20 and a shell penetration tube or shell penetration tube portion that penetrates the shell 20. The spiral tube portion may be integrally formed with the shell penetration tube portion. A plurality of shell penetration tube portions and one spiral tube portion may be configured as one refrigerant tube. The plurality of shell penetration tube portion may include a first shell penetration tube portion and a second shell penetration tube portion, which may be located before and after the spiral tube portion in a refrigerant flow direction. The spiral tube portion may be located between the first shell penetration tube portion and the second shell penetration tube portion in the refrigerant flow direction. The refrigerant may be introduced into the spiral tube portion by passing through any one of the first shell penetration tube portion or the second shell penetration tube portion, and may pass through any one of the first shell penetration tube portion or the second shell penetration tube portion after passing through the spiral tube portion. Any one of the first shell penetration tube portion or the second shell penetration tube portion may extend outside of the shell 20 by passing through at least a portion of the discharge pipe 28 and the shell 20. Any one of the first shell penetration tube portion or the second shell penetration tube portion may extend outside of the shell 20 by passing between the discharge pipe 28 and the shell 20 and penetrating the shell 20.

The plurality of refrigerant tubes 24 and 26 may be connected to the refrigerant flow path in parallel. The plurality of refrigerant tubes 24 and 26 may be disposed to penetrate the shell 20, respectively. A first end and a second end of each of the plurality of refrigerant tubes 24 and 26 may be located outside of the shell 20. The first end of the plurality of refrigerant tubes 24 and 26 located outside of the shell 20 may be connected to a branch pipe. The second end of the plurality of refrigerant tubes 24 and 26 located outside of the shell 20 may be connected to a combining pipe. The compressor outlet flow path 3, shown in FIG. 1, may be connected to the branch pipe, and the first heat exchanger expansion mechanism connecting flow path 5 may be connected to the combining pipe. The refrigerant in the compressor outlet flow path 3 may be distributed from the branch pipe to the plurality of refrigerant tubes 24 and 26, and the refrigerant that has passed through the plurality of refrigerant tubes 24 and 26 may be combined in the combining pipe, and then may flow to the first heat exchanger expansion mechanism connecting flow path 5. If lengths of the refrigerant flow paths are different from each other, the plurality of refrigerant tubes 24 and 26 may have a lower heat-exchange performance. Thus, lengths of the refrigerant flow paths may be set equal to each other, or a difference between lengths of the refrigerator flow paths may be minimized.

The plurality of refrigerant tubes 24 and 26 may include at least two refrigerant tubes through which the refrigerant may pass. The at least two refrigerant tubes may each include a tube or tube portion in which a plurality of turns may be spirally wound in succession, respectively, previously referred to as the spiral tube portion. Radiuses R1 and R2 of the spiral tube portion of the plurality of refrigerant tubes 24 and 26 may be different from each other. The radius R1 of the spiral tube portion of any one of the plurality of refrigerant tubes, for example, refrigerant tube 24, may have a shorter length than a radius R2 of the spiral tube portion of the other, for example, refrigerant tube 26, such that R2>R1. The respective spiral tube portions of the plurality of refrigerant cubes 24 and 26 may be installed to be located between a central vertical axis Z of the shell 20 and an inner circumferential surface 21 of the shell 20, respectively. The spiral tube portion of the refrigerant tube 24 having the smaller radius R1 may be installed closer to the central vertical axis Z of the shell 20 than the inner circumferential surface 21 of the shell 20. The spiral tube portion of the refrigerant tube 26 having the larger radius R2 may be installed closer to the inner circumferential surface 21 of the shell 20 than the central vertical axis Z of the shell 20. The spiral tube portion closer to the central vertical axis Z of the shell 20 may be an inner spiral tube portion, and the spiral tube portion closer to the inner circumferential surface 21 of the shell 20 may be an outer spiral tube portion. The outer spiral tube portion may be located between the inner spiral tube portion and the inner circumferential surface 21 of the shell 20. A pitch between turns of the outer spiral tube portion may be larger than a pitch between turns of the inner spiral tube portion, and a number of turn of the outer spiral tube portion may be smaller than a number of turns of the inner spiral tube portion. In this case, a flow path length of the inner spiral tube portion may be equal to a flow path length of the outer spiral tube portion, or a difference between flow path lengths may be minimized. As the spiral tube portion is closer to the inner circumferential surface 21 of the shell 20, the pitch between the turns and the number of turn may be larger.

The plurality of refrigerant tubes 24 and 26 may be connected in parallel. As indicated above, the parallel-connected refrigerant tubes may have a different pitch between the turns of the spiral tube portions and a different number of turns of the spiral tube portions, respectively. In the plurality of refrigerant tubes 24 and 26, three or four or more refrigerant tubes may be connected in parallel, and the parallel-connected refrigerant tubes may have a different pitch between the turns of the spiral tube portions and a different number of turns of the spiral tube portions, respectively, as described above. If three or more refrigerant tubes are provided, the closer the spiral tube portion of the refrigerant tube is to the inner circumferential surface 21 of the shell 20, the larger the pitch may be between the turns, and the smaller the number of turns. The closer the spiral tube portion of the refrigerant tube is to the central vertical axis Z of the shell 20, the smaller the pitch may be between the turns, and larger the number of turns.

A first end of the discharge pipe 28 thereof may be located outside of the shell 20, while a second end may be located on the inside of the shell 20. The second end of the discharge pipe 28 located inside of the shell 20 may be located at the lower side of the upper plate 33. The discharge pipe 28 may include a plurality of pipes 29, 30, one of which may be disposed inside the shell 20 and one of which may be disposed outside of and penetrating the shell 20. The plurality of pipes 29, 30 may include an inner discharge pipe 29 located inside of the shell 20, and an outer discharge pipe 30 in which the heat source fluid inside of the inner discharge pipe 29 may be discharged and guided. The portion of the discharge pipe 28 located inside of the shell 20 may be located in an inner space S of the spiral tube portion located at an innermost side of the plurality of refrigerant tubes 24 and 26. The discharge pipe 28 may be connected to the inlet pipe 12, shown in FIG. 1, via the outer discharge pipe 30 located outside of the shell 20. A top of the inner discharge pipe 29 may be separated from the upper plate 33 of the shell 20 and the bottom of the inner discharge pipe 29 may be coupled to the lower plate 31. The inner discharge pipe 29 may function as a heat source fluid guide. The heat source fluid input through the injection pipe 22 may be elevated to an upper portion of the inner space SS of the shell 20 and then dropped to be output to the outer discharge pipe 30. Accordingly, the heat source fluid introduced through the injection pipe 22 heat-exchanges with the plurality of refrigerant tubes 24 and 26, and it is possible to prevent it from being output to the outer discharge pipe 30 prior to reaching the upper portion of the inner space 55, and the inner discharge pipe 29. As set forth above, the outer discharge pipe 30 may be installed outside of the shell 20. A top of the outer discharge pipe 30 may be coupled to discharge pipe connection hole 39 formed on the lower plate 31 of the shell 20 by, for example, welding. The outer discharge pipe 30 may have a flow path cross-sectional area smaller than a flow path cross-sectional area of the inner discharge pipe 29.

Hereinafter, the plurality of refrigerant tubes 24 and 26, which may include the first refrigerant tube 24 and the second refrigerant tube 26 will be described in detail.

The first refrigerant tube 24 may have a first spiral tube portion 45, in which a plurality of turns 41, 42, 43 and 44 may be spirally wound in succession. The first spiral tube portion 45 may extend substantially vertically inside of the shell 20. The plurality of turns 41, 42, 43 and 44 of the first spiral tube portion 45 may have a same central vertical axis X and may be continuous along a spiral axis H1. At least two middle turns 42 and 43 may be formed between an uppermost turn 41 and a lowermost turn 44. An overall shape of the first spiral tube portion 45 may be a coil shape. The inner space S may be formed at an inside of the first spiral tube portion 45. The first spiral tube portion 45 may be disposed between the central vertical axis Z of the shell 20 and the hollow shell 32. The uppermost turn 41 of the first spiral tube portion 45 may be located at a lower side of the upper plate 33, the lowermost turn 44 may be located at an upper side of the lower plate 31, and an outer circumference may be separated from the inner circumferential surface 21 of the shell 20. The first refrigerant tube 24 may further include at least one shell penetration tube or shell penetration tube portion integrally formed with the first spiral tube portion 45.

Shell penetration tubes or shell penetration tube portions 46 and 47 may extend from first and second ends of the first spiral tube portion 45. The shell penetration tube portions 46 and 47 may include shell penetration tube portion 46, which may extend from the first end of the first spiral tube portion 45, and shell penetration tube portion 47, which may extend from the second end of the first spiral tube portion 45. Thus, the first refrigerant tube 24 may include one spiral tube portion 45 and two shell penetration tube portions 46 and 47. One of the two shell penetration tube portions 46 and 47 may be an inner fluid discharge pipe penetration tube portion that penetrates the inner discharge pipe 29, and the other may be an inner discharge pipe non-penetration tube portion that does not penetrate the inner discharge pipe 29. The first shell penetration tube portion 46 may extend from the uppermost turn 41 of the first spiral tube portion 45, and the second shell penetration tube portion 47 may extend from the lowermost turn 44 of the first spiral tube portion 45. A top of the first shell penetration tube portion 46 may be roundly formed from the uppermost turn 41 of the first spiral tube portion 45, and may have a vertically extending portion. The first shell penetration tube portion 46 may pass through the space S formed by the first spiral tube portion 45. The first shell penetration tube portion 46 may extend through the inner discharge pipe 29 and the lower plate 31 of the shell 20, respectively. At least a portion of the first shell penetration tube portion 46 located outside of the shell 20 may extend parallel to the outer discharge pipe 30. A top of the second shell penetration tube portion 47 may be roundly formed at the lowermost turn 44 of the first spiral tube portion 45, and have a vertically extending portion. The second shell penetration tube portion 47 may pass through the inner discharge pipe 29 and the hollow shell 32, and may penetrate the lower plate 31 of the shell 20. At least a portion of the second shell penetration tube portion 47 located outside of the shell 20 may extend parallel with the outer discharge pipe 30.

The second refrigerant tube 26 may have a second spiral tube portion 55, in which a plurality of turns 51, 52, 53 and 54 may be spirally wound in succession. The second spiral tube portion 55 may extend substantially vertically inside of the shell 20. The plurality of turns 51, 52, 53 and 54 of the second spiral tube portion 55 may have a same distance from a central vertical axis Y and may be continuous along a spiral axis H2. At least two middle turns 52 and 53 may be formed between an uppermost turn 51 and a lowermost turn 54. An overall shape of the second spiral tube portion 55 may be a coil shape. The second spiral tube portion 55 may be disposed between the first spiral tube portion 45 and the shell 20.

The second spiral tube portion 55 may have a larger pitch between turns and a smaller number of turn than the first spiral tube portion 45. Further, the second spiral tube portion 55 may have a larger gap 59 than a gap between the turns of the first spiral tube portion 55. More particularly, the first spiral tube portion 45 may have no gap between the turns or may have a gap of a predetermined height, and the second spiral tube portion 55 may have a larger gap 59 than the gap between the turns of the first spiral tube portion 45. Thus, the heat source fluid may be heat-exchanged with a lower portion of the turn 52 located at an upper side of two adjacent turns between the adjacent turns of the second spiral tube portion 55, and may be heat-exchanged with an upper portion of the turn 53 located at a lower side of the two adjacent turns. The heat source fluid may flow to the first spiral tube portion 45 by passing through the gap 59 between the turns of the second spiral tube portion 55 and be heat-exchanged by contacting with the turns of the first spiral tube portion 45.

The second spiral tube portion 55 may have the central vertical axis Y. The second spiral tube portion 55 may be installed such that the central vertical axis Y may correspond with the central vertical axis X of the first spiral tube portion 55. The central vertical axis Y of the second spiral tube portion 55 and the central vertical axis X of the first spiral tube portion 55 may correspond with the central vertical axis Z of the shell 20. The uppermost turn 51 of the second spiral tube portion 55 may be located on the lower side of the upper plate 33, the lowermost turn 54 may be located on the upper side of the lower plate 31, and the outer circumference may be separated from the inner circumference of the shell 20.

The second refrigerant tube 26 may further include at least one shell penetration tube or shell penetration tube portion integrally formed with the second spiral tube portion 55. The at least one shell penetration tube portion may include shell penetration tube portions 56 and 57, which may extend from first and second ends of the second spiral tube portion 55, respectively. The shell penetration tube portions 56 and 57 may penetrate the shell 20. The shell penetration tube portion 56 may extend from the first end of the second spiral tube portion 55, and the shell penetration tube portion 57 may extend from the second end of the second spiral tube portion 55. The second refrigerant tube 26 may include one spiral tube portion 55 and two shell penetration tube portions 56 and 57. One of the two shell penetration tube portions 56 and 57 may be an inner discharge pipe penetration tube portion, which may pass through the inner discharge pipe 29, and the other one may be an inner discharge pipe non-penetration tube portion, which may not pass through the inner discharge pipe 29. The first shell penetration tube portion 56 may extend from the uppermost turn 51 of the second spiral tube portion 55, and the second shell penetration tube portion 57 may extend from the lowermost turn 54 of the second spiral tube portion 55. A top of the first shell penetration tube portion 56 may be roundly formed to extend from the uppermost turn 51 of the second spiral tube portion 55 and may have a vertically extending portion. The first shell penetration tube portion 56 may pass through the space S formed within the first spiral tube portion 45. The first shell penetration tube portion 56 may pass through the inner discharge pipe 29 and the lower plate 31 of the shell 20, respectively. The first shell penetration tube portion 56 may be configured such that at least a portion located outside of the shell 20 may be parallel with the outer discharge pipe 30. A bottom of the second shell penetration tube portion 57 may be roundly formed to extend from the lowermost turn 54 of the second spiral tube portion 55, and may have a vertically-extending portion. The second shell penetration tube portion 57 may pass between the inner discharge pipe 29 and the hollow shell 32, and may penetrate the lower plate 31 of the shell 20. The second shell penetration tube portion 57 may be configured such that at least a portion located outside of the shell 20 may be parallel with the outer discharge pipe 30.

The number of turns of the second spiral tube portion may be determined by Equation 1 below:

$$N2=N1\times R1/R2 \quad \text{[Equation 1]}$$

where, N2 is a number of turns of the second spiral tube portion, N1 is a number of turns of the first spiral tube portion, R1 is a radius of the first spiral tube portion, and R2 is a radius of the second spiral tube portion.

The pitch between turns of the second spiral tube portion may be determined by Equation 2 below:

$$P2=P1\times N1/N2 \quad \text{[Equation 2]}$$

where, P2 is a pitch between turns of the second spiral tube portion, and P1 is a pitch between turns of the first spiral tube portion.

The pitch P2 between turns of the second spiral tube portion 55 may be approximately 1.3 to 1.5 times the pitch P1 between turns of the first spiral tube portion 45. For example, if the number of turns of the second spiral tube portion 55 is set to 11, and the number of turns of the first spiral tube portion 45 is set to 16, the pitch P2 between turns of the second spiral tube portion 55 may be approximately 1.455 times. If the number of turns of the second spiral tube portion 55 is set to 12, and the number of turns of the first spiral tube portion 45 is set to 16, the pitch P2 between turns of the second spiral tube portion 55 may be approximately 1.333 times the pitch between turns of the first spiral tube portion. If the number of turns of the second spiral tube portion 55 is set to 12, and the number of turns of the first spiral tube portion 45 is set to 17, the pitch P2 between turns of the second spiral tube portion 55 may be approximately 1.416 times the pitch between turns of the first spiral tube portion.

The refrigerant tube penetration holes 36*a*, 36*b*, 37*a*, and 37*b* may include first penetration holes 36*a* and 37*a*, through which the shell penetration tube portions of the inner discharge pipe 29 may pass, and the second penetration holes 36*b* and 37*b*, through which the shell penetration tube portion of the inner discharge pipe 29 may pass. The first penetration holes 36*a* and 37*a* may be formed at a location at the inner side of the inner discharge pipe 29. The second penetration holes 36*b* and 37*b* may be formed at a location to between the inner discharge pipe 29 and the shell 20. The inner discharge pipe 29 may have the larger flow path cross-sectional area than the flow path cross-sectional area of the outer discharge pipe 30. The flow path cross-sectional area of the inner discharge pipe 29 may be larger than a sum of areas of the discharge pipe connection hole 39 and the first penetration holes 36*a* and 37*a*. The injection pipe penetration hole 38 may be formed at a location between the inner discharge pipe 29 and the shell 20. The discharge pipe connection hole 39 may be formed at the location at the inner side of the inner discharge pipe 29 and the shell 20. The discharge pipe connection hole 39 may be helically located at a center C of the lower plate 31. The center of the discharge pipe connection hole 39 may not correspond to the center C of the lower plate 31. When the hollow shell 32 of the heat exchanger 4 is separated from the lower plate 31, the plurality of refrigerant tubes 24 and 26, the injection pipe 22 and the outer discharge pipe 30 may be fixed to the lower plate 31, and the plurality of refrigerant tubes may be washed in a state in which the hollow shell 32 is separated from the lower plate 31.

The heat exchanger 4 may include a shell holder 60 to hold the shell 20. The shell holder 60 may include a holding plate 62 to elevate the shell 20, and a plurality of supporting legs 64 and 66 to support the holding plate 62. The plurality of supporting legs 64 and 66 may include at least two supporting legs.

The heat exchanger 4 may be configured such that the inlet pipe 14, shown in FIG. 1, is connected to the injection pipe 22, and the inlet pipe 12, shown in FIG. 1, is connected to the discharge pipe 28. Accordingly, the heat source fluid in the inlet pipe 14 may be heat-exchanged with the refrigerant tube after being introduced into the inside of the shell 20 through the injection pipe 22, and the heat source fluid heat-exchanged with the refrigerant tube may be output to the inlet pipe 12 through the discharge pipe 28.

Operations of embodiments as described above will be described herein below.

First, when the air conditioner is operated, the refrigerant may be distributed and flow to the first refrigerant tube 24 and the second refrigerant tube 26, and the heat source fluid may be introduced into the inside of the shell 20 through the injection pipe 22. The refrigerant may be introduced into the first spiral tube portion 45 through one of the first shell penetration tube portion 46 or the second shell penetration tube portion 47 of the first refrigerant tube 24 and may be introduced into the second spiral tube portion 55 through one of the first shell penetration tube portion 56 or the second shell penetration tube portion 57 of the second refrigerant tube 26. The refrigerant may be passed through each of the first spiral tube portion 45 and the second spiral tube portion 55. The refrigerant in the first spiral tube portion 45 may flow to one of the first shell penetration tube portion 46 or the second shell penetration tube portion 47 of the first refrigerant tube 24, and the refrigerant in the second spiral tube portion 55 may flow to one of the first shell penetration tube portion 56 or the second shell penetration tube portion 57 of the second refrigerant tube 26. The heat source fluid may be introduced into the lower portion of the inner space SS of the shell 20 through the injection pipe 22. The heat source fluid may gradually flow from the lower portion to the upper portion of the inner space SS of the shell 20, and may be heat-exchanged with the first refrigerant tube 24 and the second refrigerant tube 26 while flowing to the upper portion of the inner space SS of the shell 20. The heat source fluid may gradually fill the inner space SS of the shell 20 and may be elevated if a speed of introduction into the inner space SS of the shell 20 is relatively slow, and the heat source fluid may be elevated while being guided by the second spiral tube portion 55 and turn-flowing in a spiral direction if the speed of introduction into the inner space SS of the shell 20 is relatively fast. The heat source fluid introduced into the inner space SS of the shell 20 may flow into the gap 59 between adjacent turns of the second spiral tube portion 55, may be heat-exchanged with each of the adjacent turns of the second spiral tube portion 55, and may be heat-exchanged with a turn at an outer circumferential portion of the first spiral tube portion 44. The heat source fluid may be spirally elevated between two adjacent turns of the second spiral tube portion 55, and the heat source fluid may be heat-exchanged with the refrigerant passing through the second spiral tube portion 55 and the refrigerant passing through the first spiral tube portion 45, respectively. The refrigerant may be heat-exchanged with the heat source fluid while passing through the refrigerant flow paths independent of each other, while passing through the first refrigerant tube 24 and the second refrigerant tube 26. As lengths of the flow paths are mutually equal to each other between the first spiral tube portion 45 and the second spiral tube portion 55, or a difference between the lengths of the flow paths is minimized, when the difference between the lengths of the flow paths is greater, degradation of the generated heat-exchange performance may be minimized, and the refrigerant and the heat source fluid may be efficiently heat-exchanged.

Figure 7:
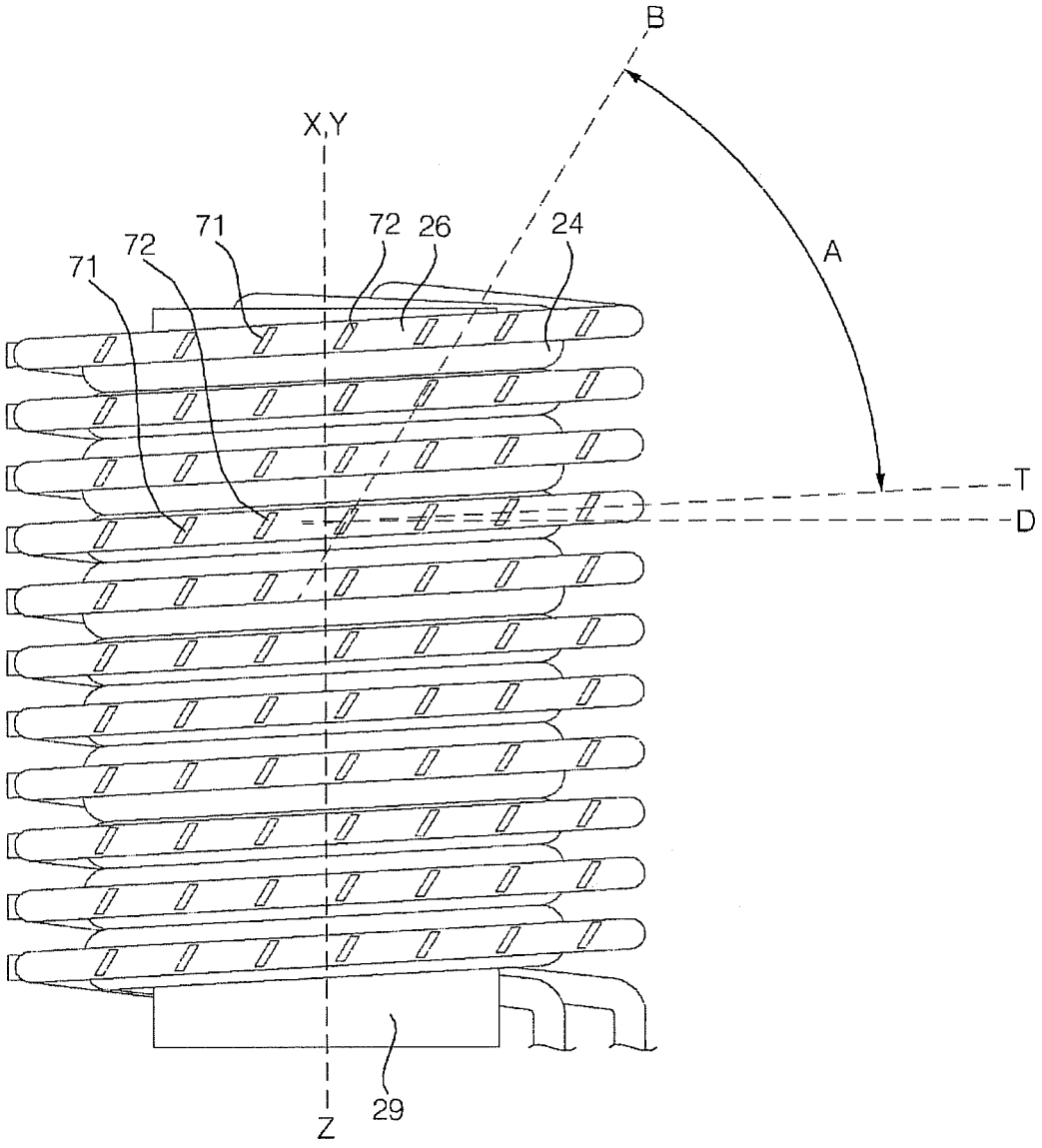
FIG. 7 is a schematic side view of the inside of a heat exchanger according to another embodiment.
Figure 8:
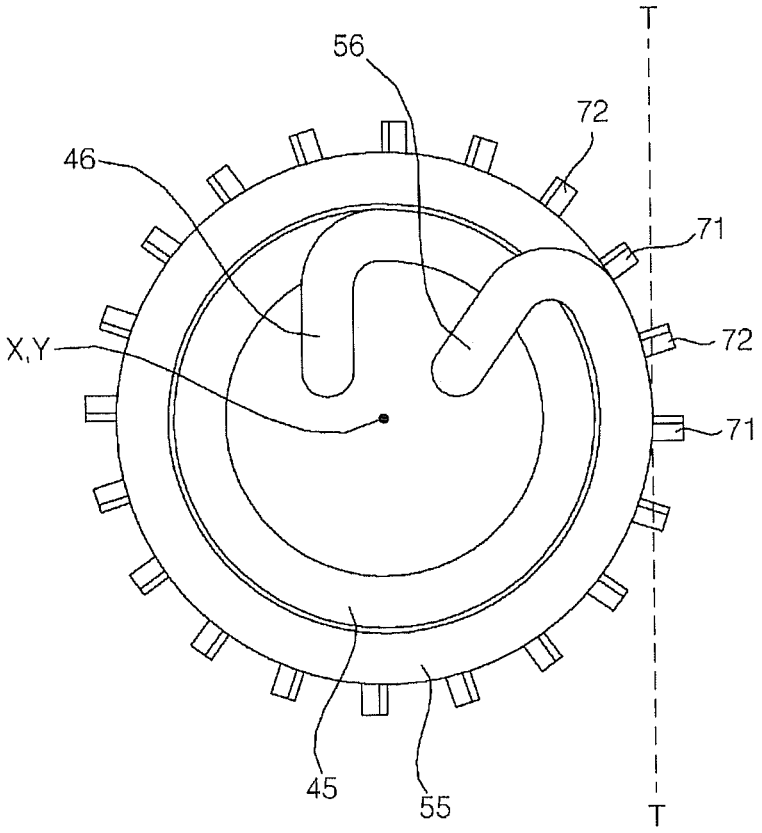
FIG. 8 is a schematic top view of the heat exchanger of FIG. 7.

FIG. 7 is a schematic side view of the inside of a heat exchanger according to another embodiment. FIG. 8 is a top view of the heat exchanger of FIG. 7.

In the heat exchanger according to this embodiment, the refrigerant tube may include at least one fin may be provided to increase heat transfer of the refrigerant and the heat source fluid. The at least one fin may protrude from an outer surface of the refrigerant tube 26. A plurality of fins 71 and 72 may be formed on the refrigerant tube. In this embodiment, as the configuration and operation other than the fins 71 and 72 may be equal to or similar to the previous embodiment, repetitive detailed description has been omitted.

The plurality of fins 71 and 72 may be formed on only a portion of the refrigerant tube 26 located within the inner space SS of the shell 20, and may not be formed on a portion located outside of the shell 20. The plurality of fins 71 and 72 may be formed on the spiral tube portion and/or an extended pipe portion, respectively. Alternatively, the plurality of fins 71 and 72 may not be formed on the extended pipe portion, and may be formed on only the spiral tube portion.

The plurality of fins 71 and 72 may be formed on each the plurality of refrigerant tubes 24 and 26, respectively, or may be formed on only the refrigerant tube 26 located at an outermost side based on the central vertical axis Z of the shell 20 and the plurality of refrigerant tubes 24 and 26. Although as shown with the embodiment of FIG. 7, the plurality of fins 71 and 72 may be formed on only the spiral tube portion of the second refrigerant tube 26, embodiments are not so limited. That is, the plurality of fins 71 and 72 may protrude from at least one of the first spiral tube portion or the second spiral tube portion.

The plurality of fins 71 and 72 may be formed to be separated from one another. When the plurality of fins 71 and 72 are formed on the spiral tube portion, the plurality of fins may be formed to be separated from each other along the spiral tube portion.

The plurality of fins 71 and 72 may protrude from the inner circumferential side and the outer circumferential side of the spiral tube portion, respectively. Alternatively, the plurality of fins 71 and 72 may be not formed on the inner circumferential side of the spiral tube portion, and may be formed on only the outer circumferential side of the spiral tube portion. Alternatively, the plurality of fins 71 and 72 may not be formed on the outer circumferential side of the spiral tube portion, and may be formed on only the inner circumferential side of the spiral tube portion.

The plurality of fins 71 and 72 may have a plate shape or a corrugated shape. Further, the plurality of fins 71 and 72 may protrude at a tilt angle A with respect to the outer circumferential surface of the spiral tube portion. The plurality of fins 71 and 72 may be formed such that a length thereof in a longitudinal direction does not correspond to a tangent T direction of the spiral tube portion. As the tangent T of the spiral tube portion is a tangent for a longitudinal direction (that is, a spiral direction) of each tube portion (that is, turn) spirally wound, and the spiral tube portion has a structure such that each turn is spirally wound along the spiral axis, it is possible to have a tilt angle of an acute angle with respect to a horizontal line D. That is, the plurality of fins 71 and 72 may have a tilt angle A with respect to the tangent T of the spiral tube portion. The tilt angle A between the plurality of fins 71 and 72 with respect to the tangent T of the spiral tube portion may be an acute angle. An extension line B extended along the longitudinal direction of the plurality of fins 71 and 72 may have the tilt angle A with respect to the tangent T of the spiral tube portion. As the tilt angle A increases, the heat source fluid may be guided in the tilt direction closer to the vertical axis. As the tilt angle A decreases, the heat source fluid may be guided in the tilt direction closer to horizontal. The heat source fluid may be elevated while spirally rotating and flowing in the shell 20. When the tilt angle A of the plurality of fins 71 and 72 is equal to or maximally similar to the spiral rotating flow direction of the heat source fluid, the heat transfer rate of the refrigerant and the heat source fluid may be maximized, and the tilt angle A of the plurality of fins 71 and 72 may be equal to the spiral rotating flow direction of the heat source fluid.

Figure 9:
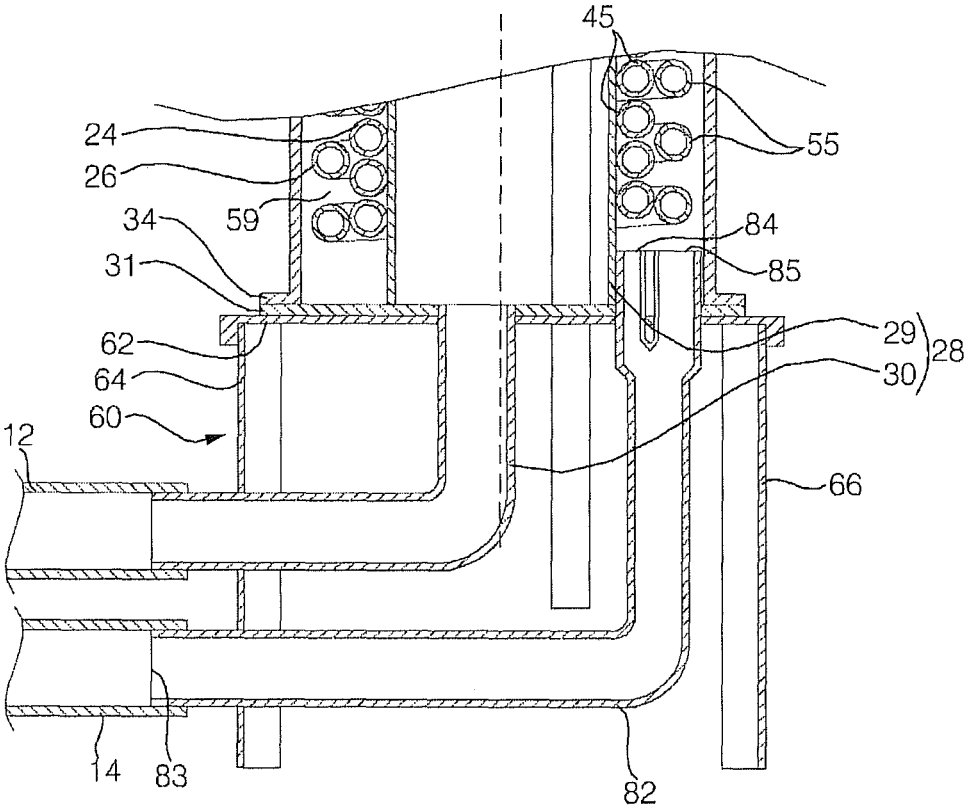
FIG. 9 is a schematic partial longitudinal cross-sectional view of a heat exchanger according to another embodiment.

FIG. 9 is a schematic partial longitudinal cross-sectional view of a heat exchanger according to another embodiment. In the heat exchanger according to this embodiment, an injection pipe 82 may be formed to distribute and introduce the heat source fluid to a plurality of locations in the shell 20. As the configuration and operation other than the injection pipe 82 may be equal to or similar to the previous embodiments, repetitive detailed description has been omitted. The heat source fluid may be distributed and introduced into the plurality of locations in the shell 20 by the injection pipe 82, and the heat source fluid distributed and introduced into the shell 20 may be heat-transmitted with the refrigerant tubes 24 and 26 maximally and uniformly. The injection pipe 82 may be configured such that a single injection pipe may distribute the heat source fluid to the plurality of locations in the shell 20.

The injection pipe 82 may be disposed in a single heat exchanger 4. The injection pipe 82 may include one inlet 83 and a plurality of outlets 84 and 85. The inlet 83 of the injection pipe 82 may be connected to the inlet pipe 14 shown in FIG. 1. The plurality of outlets 84 and 85 of the injection pipe 82 may be located inside of the shell 20, respectively. A plurality of inner flow paths may be formed on the inside of the injection pipe 82, and the heat source fluid introduced into the inlet 83 may be distributed into the plurality of outlets 84 and 85. The plurality of outlets 84 and 85 of the injection pipe 82 may be directed toward different spiral tube portions. Any one outlet 84 of the plurality of outlets 84 and 85 may be disposed to guide the heat source fluid toward the first spiral tube portion 45 of the first refrigerant tube 24. The other outlet 85 of the plurality of outlets 84 and 85 may be disposed to guide the heat source fluid toward the second spiral tube portion 55 of the second refrigerant tube 26. The inlet 83 of the injection pipe 82 may have a different diameter than a diameter of the plurality of outlets 84 and 85, and the plurality of outlets 84 and 85 may have different diameters. The outlet 85 having a larger diameter of the plurality of outlets 84 and 85 may guide the heat source fluid to the second spiral tube portion 55 of the second refrigerant tube 26. The outlet 84 having a smaller diameter of the plurality of outlets 84 and 85 may guide the heat source fluid to the first spiral tube portion 45 of the first refrigerant tube 24. When the refrigerant passes through the first spiral tube portion 45 and the second spiral tube portion 55, respectively, a centrifugal force of the refrigerant passing through the first spiral tube portion 45 may be different from a centrifugal force of the refrigerant passing through the second spiral tube portion 55, due to a radius difference between the first spiral tube portion 45 and the second spiral tube portion 55. The first spiral tube portion 45 may have a smaller rotating radius and a larger pressure loss of the refrigerant, compared to the second spiral tube portion 55. A flow amount of refrigerant in the first spiral tube portion 45 and the second spiral tube portion 55 may be non-uniformly generated due to the difference in pressure loss. As the second spiral tube portion 55 may have a smaller pressure loss than the first spiral tube portion 45, the flow amount may be larger than that of the first spiral tube portion 45. If the outlet 84 having the smaller diameter guides the heat source fluid to the first spiral tube portion 45 and the outlet 85 having the larger diameter guides the heat source fluid to the second spiral tube portion 55, a larger amount of the heat source fluid may be guided to the second spiral tube portion 55, and the refrigerant may be generally heat-exchanged with the heat source fluid uniformly.

Figure 10:
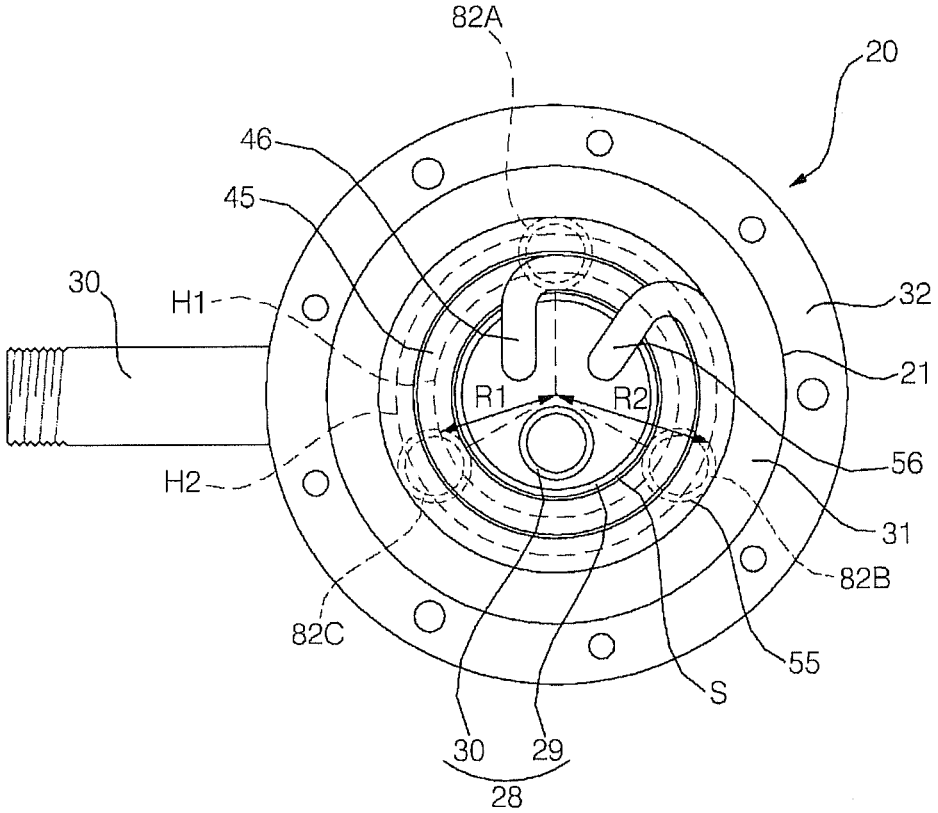
FIG. 10 is a schematic top view of a plurality of injection pipes in a heat exchanger according to another embodiment.
Figure 11:
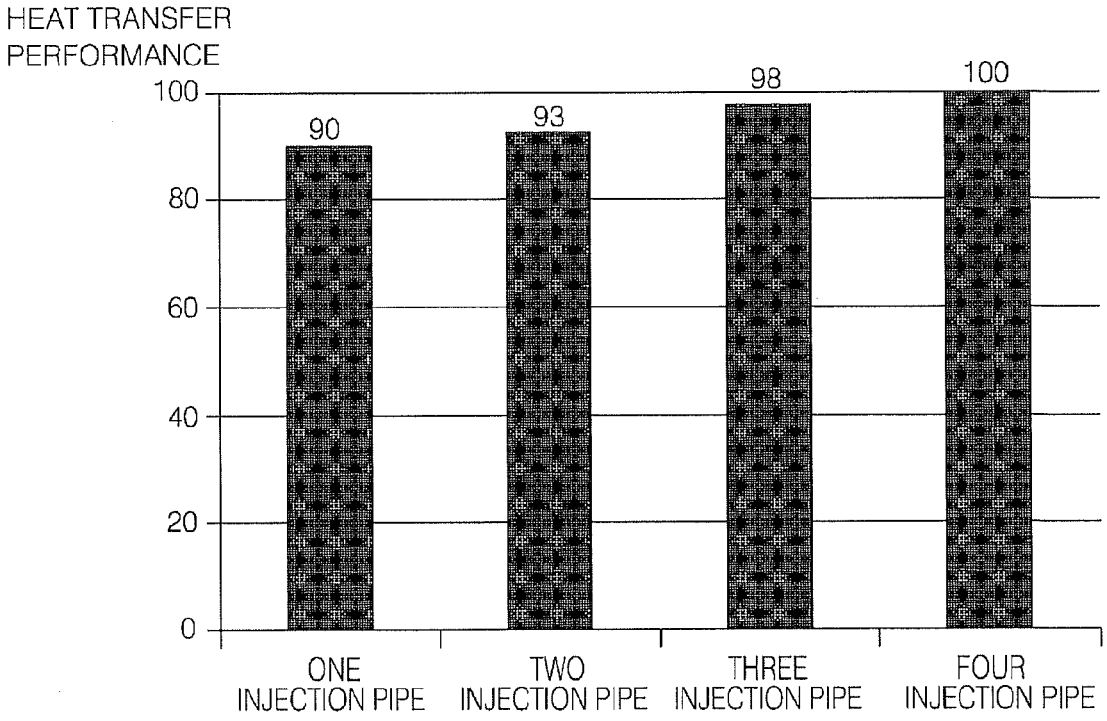
FIG. 11 is a graph illustrating heat transfer performance based on a number of injection pipes in the heat exchanger of FIG. 10.

FIG. 10 is a schematic top view of a plurality of injection pipes in a heat exchanger according to another embodiment. FIG. 11 is a graph illustrating heat transfer performance based on a number of injection pipes in the heat exchanger of FIG. 10.

In the heat exchanger according to this embodiment, a plurality of injection pipes 82A, 82B and 82C may be separately provided for the shell 20 so that the heat source fluid may be distributed into a plurality of locations in the shell 20. As the configuration and operation other than the plurality of injection pipes 82A, 82B, and 82C may be equal to or similar to the previous embodiments, repetitive detailed description has been omitted. The plurality of injection pipes 82A, 82B and 82C may be provided together for a single heat exchanger 4. The heat exchanger may further include a branch pipe (not shown) to be connected with the plurality of injection pipes 82A, 82B, and 82C. The branch pipe may be connected to the inlet pipe 14 shown in FIG. 1, the heat source fluid may be distributed into the plurality of injection pipes 82A, 82B, and 82C from the branch pipe after being introduced into the branch pipe from the inlet pipe 14, and may be input to the inside of the shell 20 from each of the plurality of injection pipes 82A, 82B and 82C. The branch pipe may have one inlet and a plurality of outlets, and a number of the plurality of outlets may correspond to the number of injection pipes 82A, 82B, and 82C. The plurality of injection pipes 82A, 82B, and 82C may be configured such that each inlet may be connected to the branch pipe from the outside of the shell 20. The plurality of injection pipes 82A, 82B, and 82C may be configured such that each outlet may be located on the inside of the shell 20. The plurality of injection pipes 82A, 82B, and 82C may have the same diameter or a different diameter. If the plurality of injection pipes has different diameters, the injection pipe having a larger diameter may be disposed to guide the heat source water to the second spiral tube portion 55 of the second refrigerant tube 26, and the injection pipe having a smaller diameter may be disposed to guide the heat source fluid to the first spiral tube portion 45 of the first refrigerant tube 24. The plurality of injection pipes 82A, 82B, and 82C may be disposed to face the first spiral tube portion 45 of the first refrigerant tube 24 and the second spiral tube portion 55 of the second refrigerant tube 26, respectively.

The plurality of injection pipes 82A, 82B, and 82C may be disposed in the shell 20 at regular intervals. For example, if two injection pipes are provided, they may be arranged at approximately 180° intervals. If three injection pipes are provided, they may be arranged at approximately 120° intervals. If four injection pipes are provided, they may be arranged at approximately 90° intervals. Referring to FIG. 11, the larger the number of injection pipes, the greater the improvement in heat transfer performance. FIG. 11 is a graph illustrating heat transfer performance in a case that various factors, for example, size of the shell 20, diameters of the injection pipes 82A, 82B and 82C, flow rates may be the same, and the number of the injection pipes 82A, 82B, and 82C and intervals of the water injection pipes 82A, 82B, and 82C may be different, such factors affecting heat transfer performance of the heat exchanger. As shown with the embodiment of FIG. 10, three injection pipes 82A, 82B and 82C may be installed at regular intervals in order to minimize fabricating costs of the heat exchanger and ensure sufficient heat transfer performance.

Figure 12:
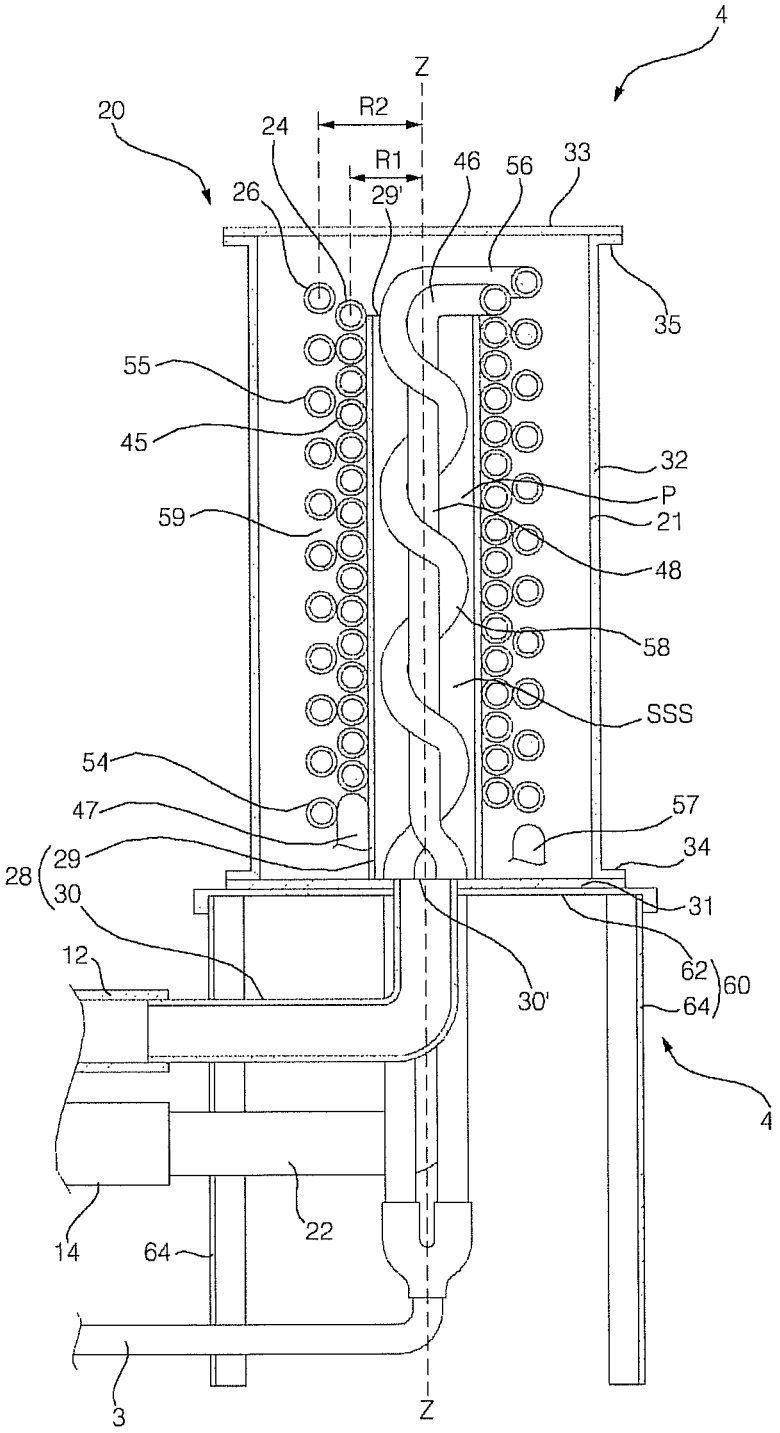
FIG. 12 is a schematic longitudinal cross-sectional view of a heat exchanger according to another embodiment.
Figure 13:
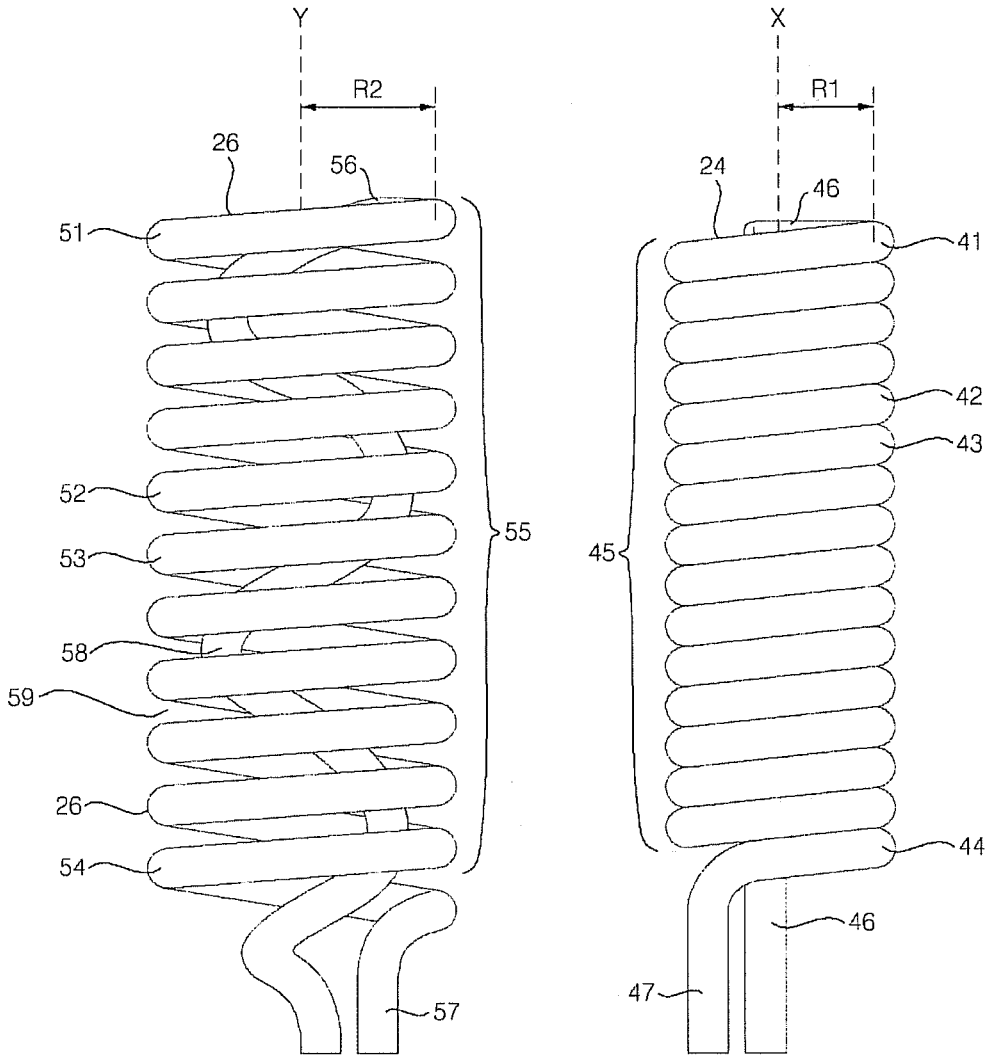
FIG. 13 is a schematic exploded perspective view of a plurality of refrigerant tube in the heat exchanger of FIG. 12.

FIG. 12 is a schematic longitudinal cross-sectional view of a heat exchanger according to another embodiment. FIG. 13 is a side exploded perspective view a plurality of refrigerant tubes in the heat exchanger of FIG. 12.

In the heat exchanger according to this embodiment, as shown in FIGS. 12 and 13, the shell penetration portion penetrating the inner discharge pipe 29 may have a center spiral tube portion 58. The center spiral tube portion 58 may be spirally formed. The center spiral tube portion 58 may have a shape such that the plurality of turns is spirally wound around the central vertical axis in succession. The center spiral tube portion 58 may have a gap formed between the plurality of turns, the gap being formed in a spiral shape. The heat source fluid in the shell 20 may be introduced into the inner space SSS of the inner discharge pipe 29 through a top 29' of the inner discharge pipe 29. The heat source fluid introduced into the inner discharge pipe 29 may be guided to the center spiral tube portion 58 to rotate and flow spirally when passing through the inside of the inner discharge pipe 29, and may be heat-exchanged with the center spiral tube portion 58 while passing through the inner discharge pipe 29. The center spiral tube portion 58 may be disposed in the inner space SSS of the inner discharge pipe 29 to form the spiral rotating flow path. In such a heat exchanger, as the configuration and operation other than the center spiral tube portion 58 may be equal to or similar to the previous embodiments, repetitive detailed description has been omitted.

If the heat exchanger 4 includes the plurality of refrigerant tubes 24 and 26, the center spiral tube portion 58 may be formed to extend from each of the plurality of refrigerant tubes 24 and 26. Alternatively, the center spiral tube portion 58 may be formed to extend from only one of the plurality of refrigerant tubes 24 and 26, and the center spiral tube portion may not be formed on the other one of the plurality of refrigerant tubes 24 and 26.

The shell penetration portion 46 of any one of the plurality of refrigerant tubes 24 and 26, which penetrate the inner discharge pipe 29, may have a straight pipe portion 48. The shell penetration portion 56 of the other one of the plurality of refrigerant tubes 24 and 26, which penetrates the inner discharge pipe 29 may have the spirally wound center spiral tube portion 58. The heat source fluid introduced into the top 29' of the inner discharge pipe 29 may spirally rotate and flow along the gap of the center spiral tube portion 58. The center spiral tube portion 58 may be a third spiral tube portion distinguished from the first spiral tube portion 45 and the second spiral tube portion 55. The center spiral tube portion 58 may have a smaller radius than the radius of the first spiral tube portion 45 and the second spiral tube portion 55.

The center spiral tube portion 58 may be located between an outer peripheral surface of the straight pipe portion 48 and an inner peripheral surface of the inner discharge pipe 29, and a spiral rotating flow path P may be formed between the straight pipe portion 48 and the inner discharge pipe 29. The center spiral tube portion 58 may contact with the inner peripheral surface of the inner discharge pipe 29. That is, the outer circumference of the center spiral tube portion 58 may contact the inner peripheral surface of the inner discharge pipe 29. The heat source fluid introduced into the inner space SSS of the inner discharge pipe 29 through the top 29' of the inner discharge pipe 29 may minimize flow between the inner peripheral surface of the inner discharge pipe 29 and the outer circumference of the center spiral tube portion 58. The center spiral tube portion 58 may contact an outer peripheral surface of the straight pipe portion 48. That is, an inner circumference of the center spiral tube portion 58 may contact the outer peripheral surface of the straight pipe portion 48. The heat source fluid introduced into the inner space SSS of the inner discharge pipe 29' through the top 29 of the inner discharge pipe 29 may minimize flow between the outer peripheral surface of the straight pipe portion 48 and the inner circumference of the center spiral tube portion 58.

In the heat exchanger according to this embodiment, the heat source fluid may be introduced into the inner space SS of the shell 20 through the injection pipe 22. The heat source fluid introduced into the inner space SS of the shell 20 may flow to the upper portion of the inner space SS of the shell 20 from the lower portion of the inner space SS of the shell 20, may be heat-exchanged with the first spiral tube portion 45 and the second spiral tube portion 55 while being spirally rotating and flowing along the second spiral tube portion 55 as the heat source fluid is elevated. In addition, the heat source fluid elevated to the upper portion of the inner space SS of the shell 20 may be introduced into the top 29' of the inner discharge pipe 29. The heat source fluid introduced into the top 29' of the inner discharge pipe 29 may spirally rotate and flow along the center spiral tube portion 58. The heat source introduced into the top 29' of the inner discharge pipe 29 may be dropped while being spirally rotating and flowing along the spiral rotating flow path P formed in the inner discharge pipe 29. At this time, the center spiral tube portion 58 and the straight pipe portion 48 may be heat-transferred. The heat source fluid may flow to the lower portion of the inner space SSS of the inner discharge pipe 29 along the spiral rotating flow path P, and then it may be introduced into the top 30' of the outer discharge pipe 30 from the lower portion of the inner space of the inner discharge pipe 29. The heat source fluid introduced into the top 30' of the outer discharge pipe 30 may pass through the outer discharge pipe 30.

Figure 14:
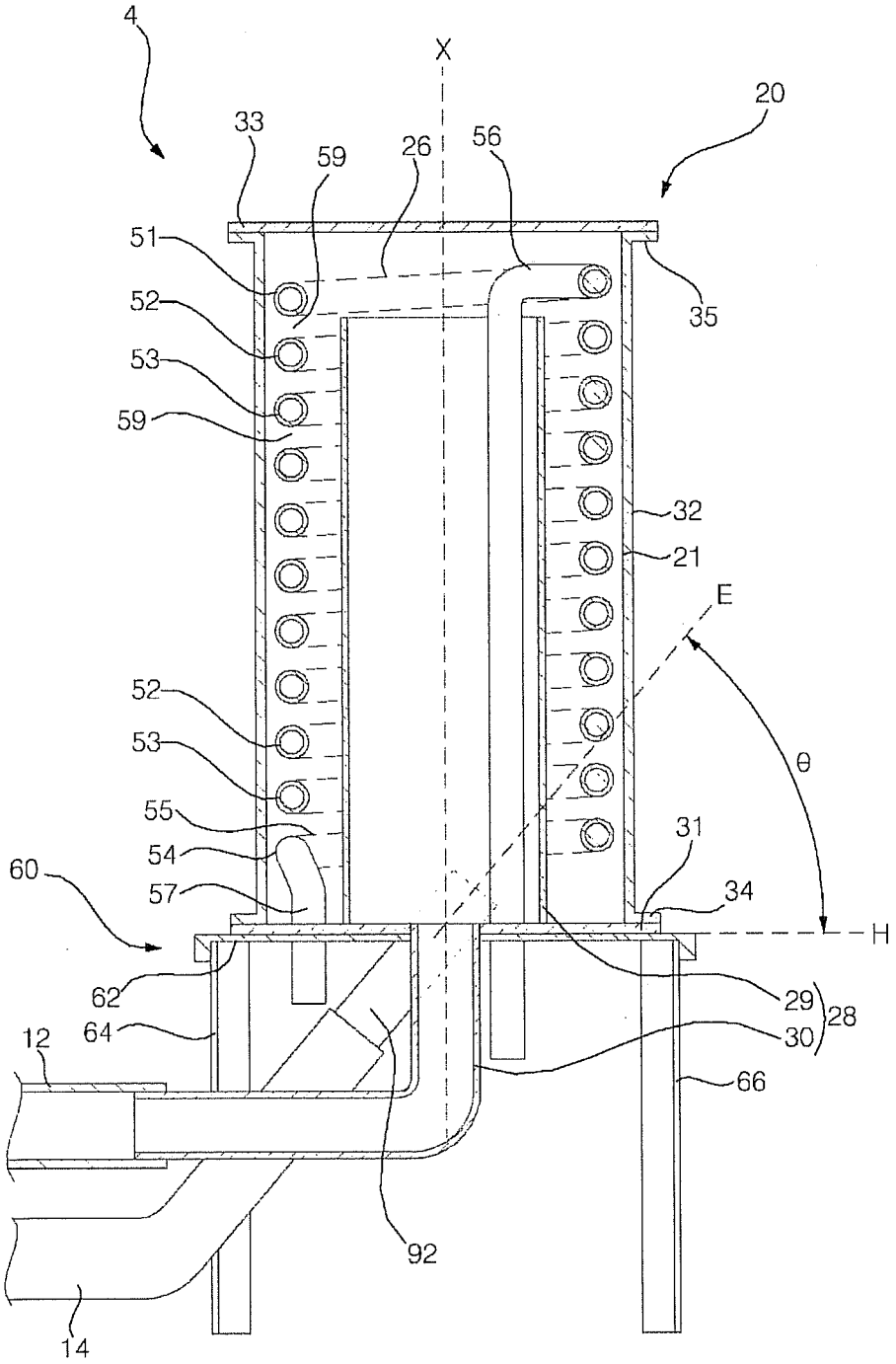
FIG. 14 is a schematic longitudinal cross-sectional view of a heat exchanger according to another embodiment.
Figure 15:
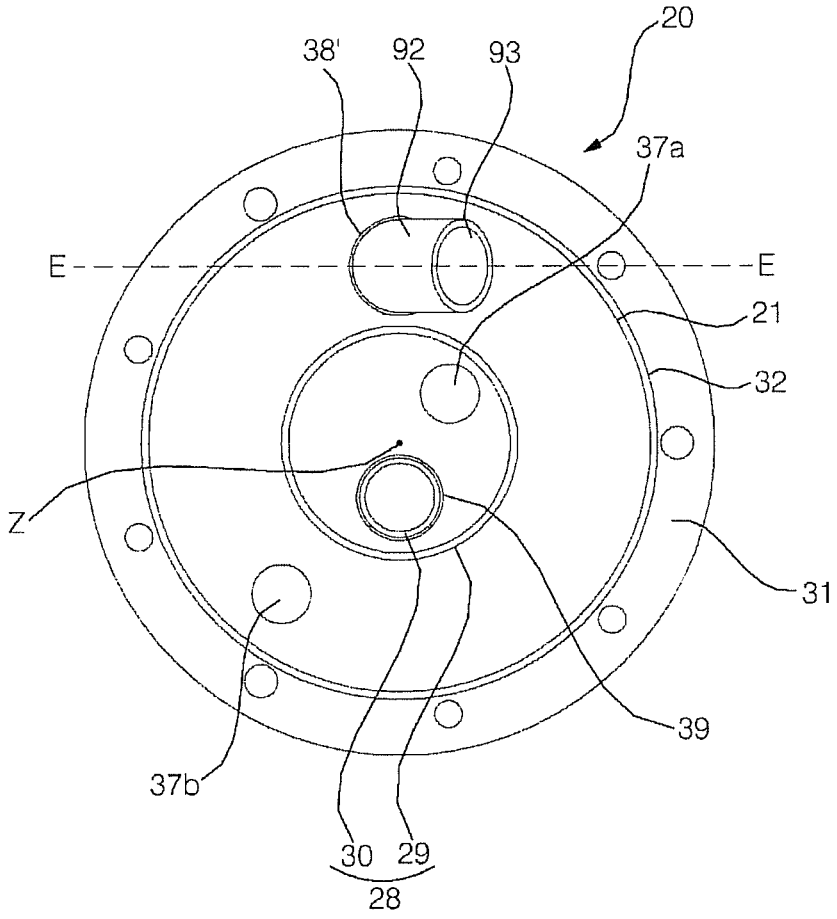
FIG. 15 is a schematic internal top view of an injection pipe and a discharge pipe of the heat exchanger of FIG. 14.
Figure 16:
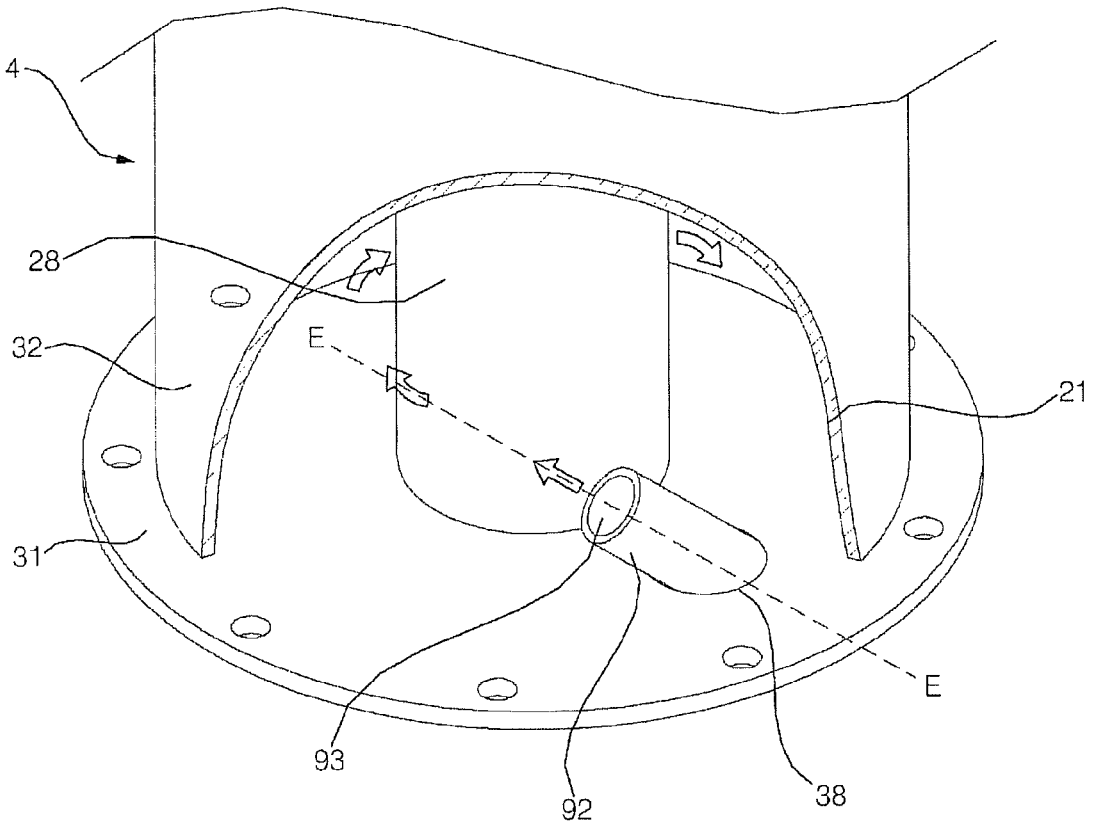
FIG. 16 is a schematic partial-notched perspective view of the inside of the heat exchanger of FIG. 14.

FIG. 14 is a schematic longitudinal cross-sectional view of a heat exchanger according to another embodiment. FIG. 15 is a schematic internal top view of an injection pipe and a discharge pipe in the heat exchanger of FIG. 14. FIG. 16 is a schematic partial-notched perspective view of an inside of the heat exchanger of FIG. 14.

In this embodiment, as shown in FIGS. 14 to 16, an outlet 93 of an injection pipe 92 may be installed to be opposed to an inner peripheral surface 21 of the hollow shell 32. As the configuration and operation other than the injection pipe 92 may be equal to or similar to the previous embodiments, repetitive detailed description has been omitted.

For convenience, although FIG. 14 shows a singular refrigerant tube 26, embodiments are not limited to the single refrigerant tube; rather, a plurality of refrigerant tubes may be installed together within one shell 20. That is, two refrigerant tubes may be installed in one shell 20, or three or four refrigerant tubes may be installed in one shell 20. The refrigerant tube 26 may include the spiral tube portion 55, the first shell penetration portion 56, and the second shell penetration portion 57. The spiral tube portion 55 may be configured such that the plurality of turns 51, 52, 53 and 54 may be spirally formed in succession, and the plurality of turns 51, 52, 53 and 54 may have the same distance from the central vertical axis X of the spiral tube portion 55. The spiral tube portion 55 may be configured such that the gap 59 may be formed between turns. The gap 59 may be spirally formed. The heat source fluid may be heat-exchanged with the refrigerant tube 26 while passing through the gap 59, and fluid may be heat-exchanged with the refrigerant tube 26 while spirally rotating and flowing along the gap 59.

A first end of the injection pipe 92 may be located outside of the shell 20, and a second end thereof may be located inside of the shell 20. The second end may be located at an upper side of the lower plate 31. The injection pipe 92 may be configured as one member. The injection pipe 92 may be configured as an inner injection pipe located inside of the shell 20 and an outer injection pipe located outside of the shell 20. When the injection pipe 92 includes the inner injection pipe and the outer injection pipe, one of the inner injection pipe or the outer discharge pipe may penetrate the lower plate 31. When the injection pipe 92 includes the inner injection pipe and the outer injection pipe, one of the inner injection pipe or the outer discharge pipe may be installed to be interposed with the lower plate 31. The injection pipe 92 may be configured such that the first end thereof located outside of the shell 20 is an inlet. The injection pipe 92 may be configured such that the second end located at the upper side of the lower plate 31 is an outlet to the inside of the shell 20. In such a heat exchanger, a flow direction of the heat source fluid may be determined according to a direction in which the outlet 93 outputs the heat source fluid, that is, a direction by which the heat source fluid is input to the inside of the shell 20. The injection pipe 92 may be disposed such that the heat source fluid may spirally rotate and flow along the inner circumferential surface 21 of the shell 20. The injection pipe 92 may be disposed such that the outlet 93 by which the heat source fluid is input to the inner space SS of the shell 20 may be opposed to the inner circumferential surface 21 of the hollow shell 32. The injection pipe 92 may include an inclined pipe obliquely disposed on the lower plate 31. The inclined pipe may be installed to be obliquely opposed to the inner circumferential surface 21 of the hollow shell 32. The injection pipe 92 may be obliquely installed to have a tilt angle θ of an acute angle with respect to the lower plate 31. The lower plate 31 may be disposed in parallel to a horizontal line H, and the injection pipe 92 may be disposed such that the outlet 93 may have a tilt angle θ of an acute angle with respect to the horizontal line H. The injection pipe 92 may be obliquely installed on the lower plate 31. An injection pipe penetration hole 38' formed on the lower plate 31 may be obliquely formed. As shown in FIG. 13, the injection pipe 92 may be installed such that an extension line E does not intersect with the central vertical axis Z of the shell 20. A single or a plurality of injection pipe 92 may be installed in the shell 20. If a single injection pipe 92 is installed, a plurality of outlets 93 may be installed, and the plurality of outlet 93 may be disposed to be angled with respect to the inner circumferential surface 21 of the shell 20. If the plurality of injection pipes 92 is installed, the heat source fluid may be input to a plurality of locations between the shell 20 and the discharge pipe 28. If the plurality of injection pipes 92 is installed, each outlet thereof may be installed to be angled with respect to the inner circumferential surface 21 of the shell 20. If the plurality of injection pipes 92 is installed, they may be separately interposed with the discharge pipe 28, and at least three injection pipes may be disposed at regular intervals.

The refrigerant may be introduced into the spiral tube portion 55 through any one of the first shell penetration tube portion 56 or the second shell penetration tube portion 57, and after sequentially passing through the plurality of turn 51, 52, 53, and 54 of the spiral tube portion 55, it may pass through any one of the first shell penetration tube portion 56 or the second shell penetration tube portion 57. The heat source fluid may be introduced into the inner space SS of the shell 20 through the injection pipe 92. When the heat source fluid passes through the outlet 93 from the injection pipe 92, the input direction may be determined. As the outlet 93 may face the inner circumferential surface 21 of the hollow shell 32, the heat source fluid may be obliquely input to the inner circumferential surface 21 of the hollow shell 32. The heat source fluid may rotate and flow along the inner circumferential surface 21 of the hollow shell 32, may rotate and flow in the spiral direction due to centrifugal force, and may contact and be heat-exchanged with the spiral tube portion 55 while rotating and flowing in the spiral direction. The spiral tube portion 55 may be heat-exchanged with the heat source fluid using a wider contact area than a case in which the heat source fluid may be upwardly input in the vertical direction so that heat-exchange performance may be improved. The heat source fluid may be elevated from the lower portion of the inner space to the upper portion of the inner space SS of the shell 20 while rotating and flowing in the spiral direction, and may be introduced to the upper portion of the inner space SS of the shell 20, and the flowing heat source fluid may be introduced into the top of the discharge pipe 28 and flow outside of the shell 20 through the discharge pipe 28.

Figure 17:
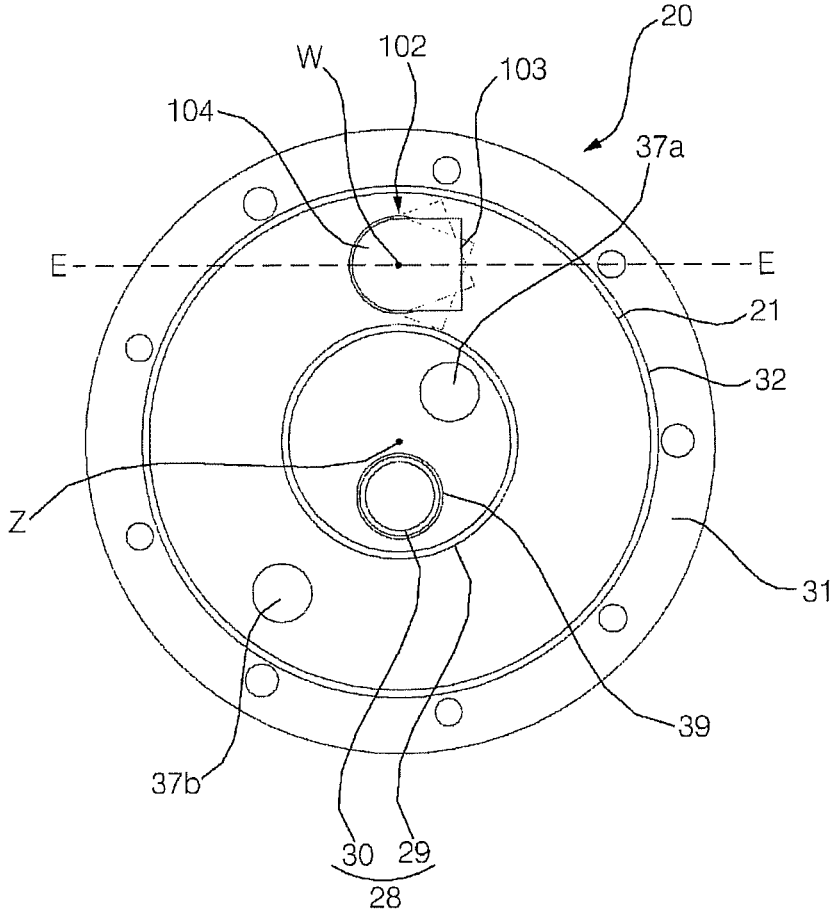
FIG. 17 is a schematic internal top view of an injection pipe and a discharge pipe in a heat exchanger according to another embodiment.
Figure 18:
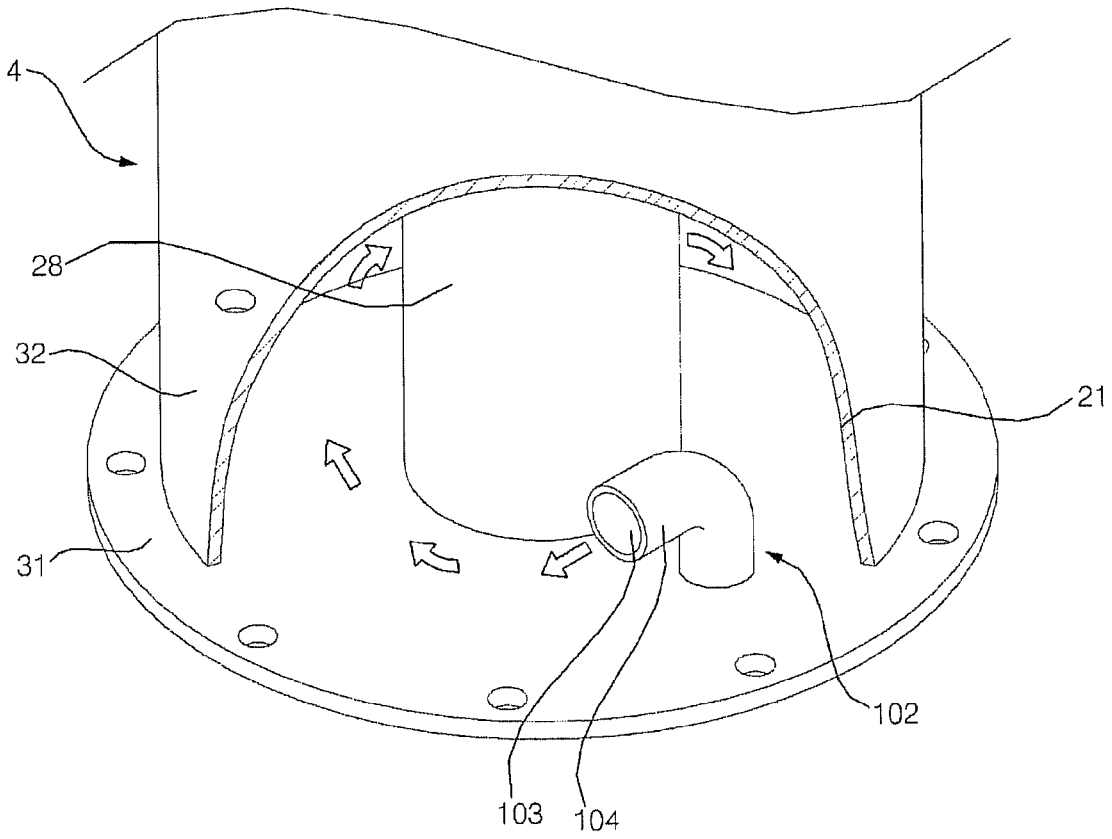
FIG. 18 is a schematic partial-notched perspective view of the inside of the heat exchanger of FIG. 17.
Figure 19:
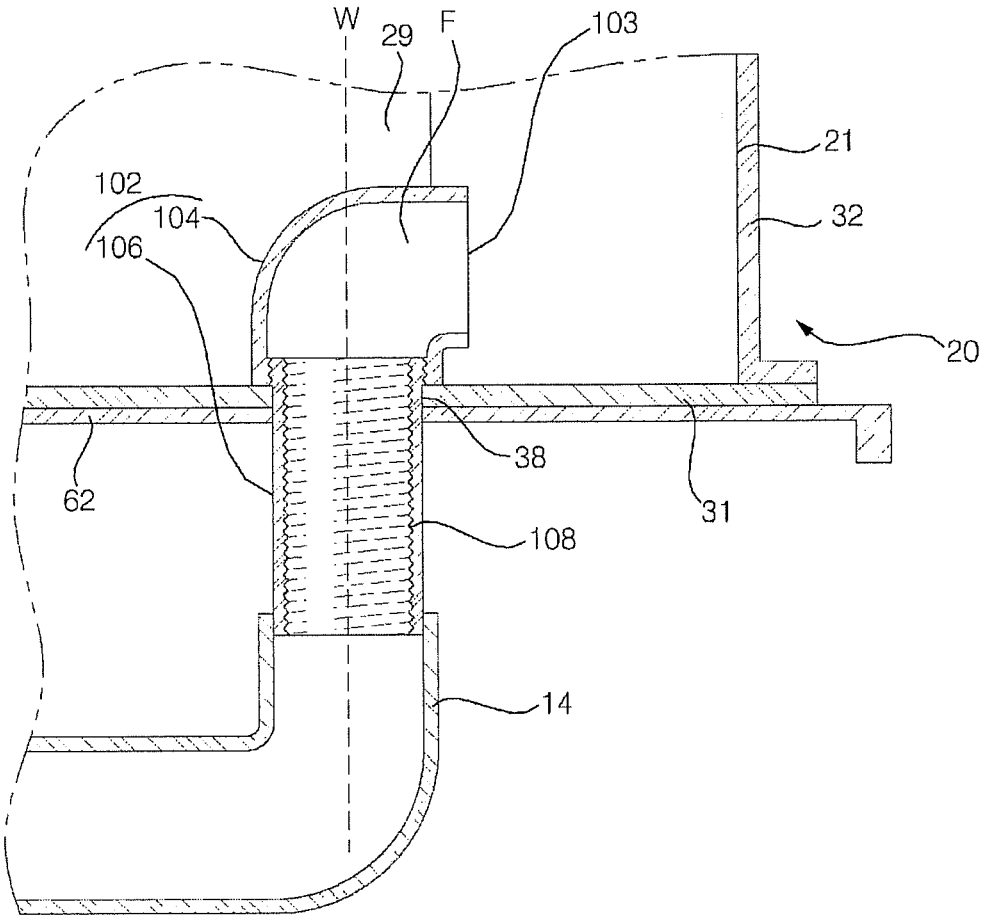
FIG. 19 is a schematic enlarged cross-sectional view of an injection pipe in the heat exchanger of FIG. 18.

FIG. 17 is a schematic internal top view of an injection pipe and a discharge pipe in a heat exchanger according to another embodiment. FIG. 18 is a schematic partial-cutout perspective view of an inside of the heat exchanger of FIG. 17. FIG. 19 is a schematic enlarged cross-sectional view of the injection pipe in the heat exchanger of FIG. 17.

In this embodiment, as shown in FIGS. 17 to 19, the injection pipe 102 may include a bent pipe 104 having an outlet 103, the bent pipe 104 may be formed such that at least a portion thereof may be located inside of the shell 20, and a curved type flow path C may be formed in an inside thereof. With this embodiment, as the configuration and operation other than the injection pipe 102 may be equal to or similar to the previous embodiment, repetitive detailed description has been omitted.

The bent pipe 104 may be installed such that the outlet 103 is located inside of the shell 20. The bent pipe 104 may be installed such that the outlet 103 is opposed to the inner peripheral surface 40 of the hollow shell 32. The bent pipe 104 may determine an input direction of the heat source fluid in a direction that the outlet 103 turns. The outlet 103 of the bent pipe 104 may be opened in a horizontal direction, or may be opened in an upwardly tilted direction. The outlet 103 of the bent pipe 104 may be located between the inner circumferential surface 21 of the hollow shell 32 and the outer peripheral surface of the inner discharge pipe 29, and the heat source fluid may be input from the outlet 103 to the inner circumferential surface 21 of the hollow shell 32. The outlet 103 may be opened in a direction parallel with a horizontal line or in the upwardly tilted direction having a tilt angle at an acute angle with respect to the horizontal line. The outlet 103 may be opened in a direction parallel with a tangential direction of the hollow shell 32.

The bent pipe 104 may be disposed to be rotated inside of the shell 20. The bent pipe 104 may be installed to be rotated about a central vertical axis W. The bent pipe 104 may be rotated in a direction that the outlet 103 turns along a rotating direction location. If the outlet 103 of the bent pipe 104 is rotated to a location that assures maximum heat-exchange performance, the heat exchanger may maximize the heat-exchange of the heat source fluid with the refrigerant.

The bent pipe 104 may be installed such the overall outlet 103 is opposed to the inner circumferential surface 21 of the hollow shell 32, as well as the outer circumferential surface of the inner discharge pipe 29. The injection pipe 102 may be installed such that a lower portion of the bent pipe 104 protrudes from the lower portion of the shell 20, and the inlet pipe 14, shown in FIG. 1, may be connected to the lower portion of the bent pipe 104. Accordingly, after the heat source fluid guided to the inlet pipe 14 is introduced into the lower portion of the bent pipe 104, it may be directed toward the inner circumferential surface 21 of the hollow shell 32 through the outlet 103 of the bent pipe 104. In this case, the injection pipe 102 may be configured such that the lower portion of the bent pipe 104 is coupled to the injection pipe penetration hole 38 of the lower plate 31. A male screw may be formed on a lower outer circumference of the bent pipe 104, and a female screw may be formed on the injection pipe penetration hole 38. The injection pipe 102 may be configured such that the lower portion of the bent pipe 104 is inserted into the injection pipe penetration hole 38 while the bent pipe 104 is rotated. In addition, if the outlet 103 of the bent pipe 104 reaches a location opposed to the inner circumferential surface 21 of the hollow shell 32, rotating of the bent pipe 104 may be stopped. If the bent pipe 104 reaches a location opposed to the inner circumferential surface 21 of the hollow shell 32 and the outer circumferential surface of the inner discharge pipe 29, rotating of the bent pipe 104 may be stopped.

The injection pipe 102 may further include an outer injection pipe 106 at least a portion of which may be located outside of the shell 20, and the heat source fluid may be guided to the bent pipe 104. The injection pipe 102 may include both the bent pipe 104 and the outer injection pipe 106, and after the heat source fluid may be guided to the outer injection pipe 106 may be guided to the bent pipe 104, it may be input to the inner space SS of the shell 20. If the injection pipe 102 includes both the bent pipe 104 and the outer injection pipe 106, each of the bent pipe 104 and the outer injection pipe 106 may be, for example, welded to the lower plate 31. If the injection pipe 102 includes both the bent pipe 104 and the outer injection pipe 106, one of the bent pipe 104 or the outer injection pipe 106 may be, for example, welded to or combined with the lower plate 31 to be fixed to the lower plate 31, the bent pipe 104 and the outer injection pipe 106 may be coupled to be connected to each other, and the bent pipe 104 and the outer injection pipe 106 may be combined or welded. The outer injection pipe 106 may penetrate the lower plate 31 such that the upper portion is located on the inside of the shell 20, and the bent pipe 104 may be configured such that the lower portion of the bent pipe 104, for example, combined with or welded to the upper portion of the outer injection pipe 106 in a state that the overall pipe is located inside of the shell 20. The injection pipe 102 may include a spiral groove 108 formed on an inner circumference thereof. The spiral groove 108 may be formed on at least an inner circumference of the bent pipe 104 or the outer injection pipe 106. If the spiral groove 108 is formed on the inner circumference of the outer injection pipe 106, the heat source fluid guided to the inside of the outer injection pipe 106 may be introduced into the bent pipe 104 while spirally rotating and flowing along the spiral groove 108 of the outer injection pipe 106, and may be input to the shell 20 by passing through the bent pipe 104 and maintaining spiral rotating and flowing due to the centrifugal force.

In the heat exchanger according to this embodiment, when the heat source fluid passes through the bent pipe 104, the flowing direction may be converted in the tilt direction, which is approximately horizontal or closer to the horizontal, and the heat source fluid may be input toward the inner circumferential surface 21 of the hollow shell 32 by passing through the outlet 103 of the bent pipe 104. The heat source fluid input through the outlet 103 of the bent pipe 104 may flow by spiral rotating and flowing between the hollow shell 32 and the inner discharge pipe 29 while rotating along the inner circumferential surface 21 of the hollow shell 32. Then, the heat source fluid may be elevated while rotating and flowing to the upper portion of the inner space SS of the shell 20 in the spiral direction, as described in the previous embodiment, and the heat source fluid flowing to the upper portion of the inner space SS of the shell 20 may be introduced into the top of the inner discharge pipe 29 and flow to the outside of the shell 20 through the discharge pipe 28.

Figure 20:
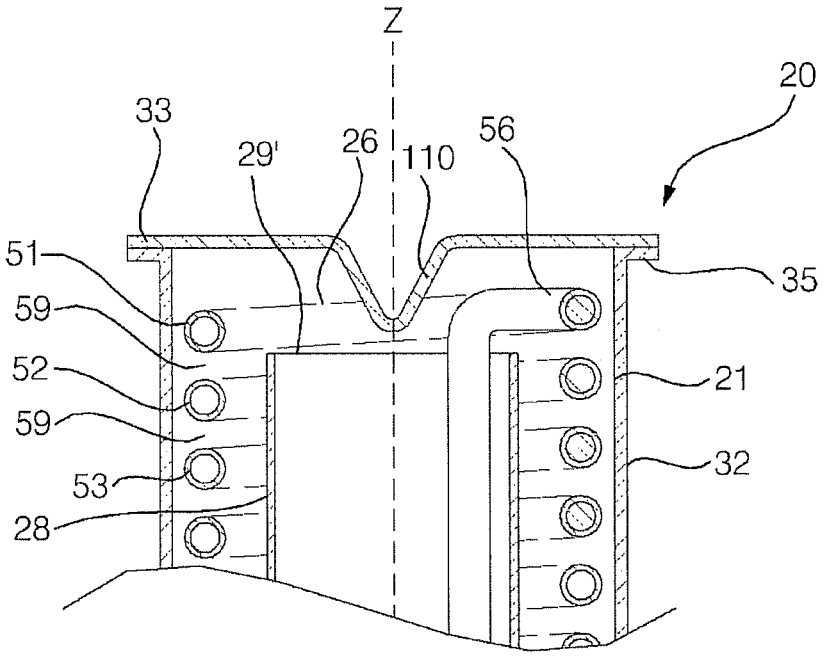
FIG. 20 is a schematic partial longitudinal cross-sectional view of a heat exchanger according to another embodiment.

FIG. 20 is a schematic partial longitudinal cross-sectional view of a heat exchanger according to another embodiment of. In this embodiment, as shown in FIG. 20, an upper guide 110 may be formed on the upper plate 33, the upper guide 110 inducing the heat source fluid to the top 29' of the discharge pipe 28. The upper guide 110 may downwardly protrude in a conical shape from the upper plate 33. As the configuration and operation other than the upper guide 110 may be equal to or similar to the previous embodiment, repetitive detailed description has been omitted.

In the heat exchanger according to this embodiment, the heat source fluid introduced inside of the shell 20 from the injection pipe may be elevated while spirally rotating and flowing along the inner circumferential surface 21 of the hollow shell 32, as described in the previous embodiments, and the heat source fluid flowing to the upper portion of the inner space SS of the shell 20 may be guided to the upper guide 110 to be induced into the top 29' of the discharge pipe 28. The heat source fluid guided to the upper guide 110 does not hover around or at the upper side location of the top 29' of the discharge pipe 28, may pass through the top 29' of the discharge pipe 28, and may be dropped to the inside of the discharge pipe 28 to flow outside of the shell 20 through the discharge pipe 28.

Figure 21:
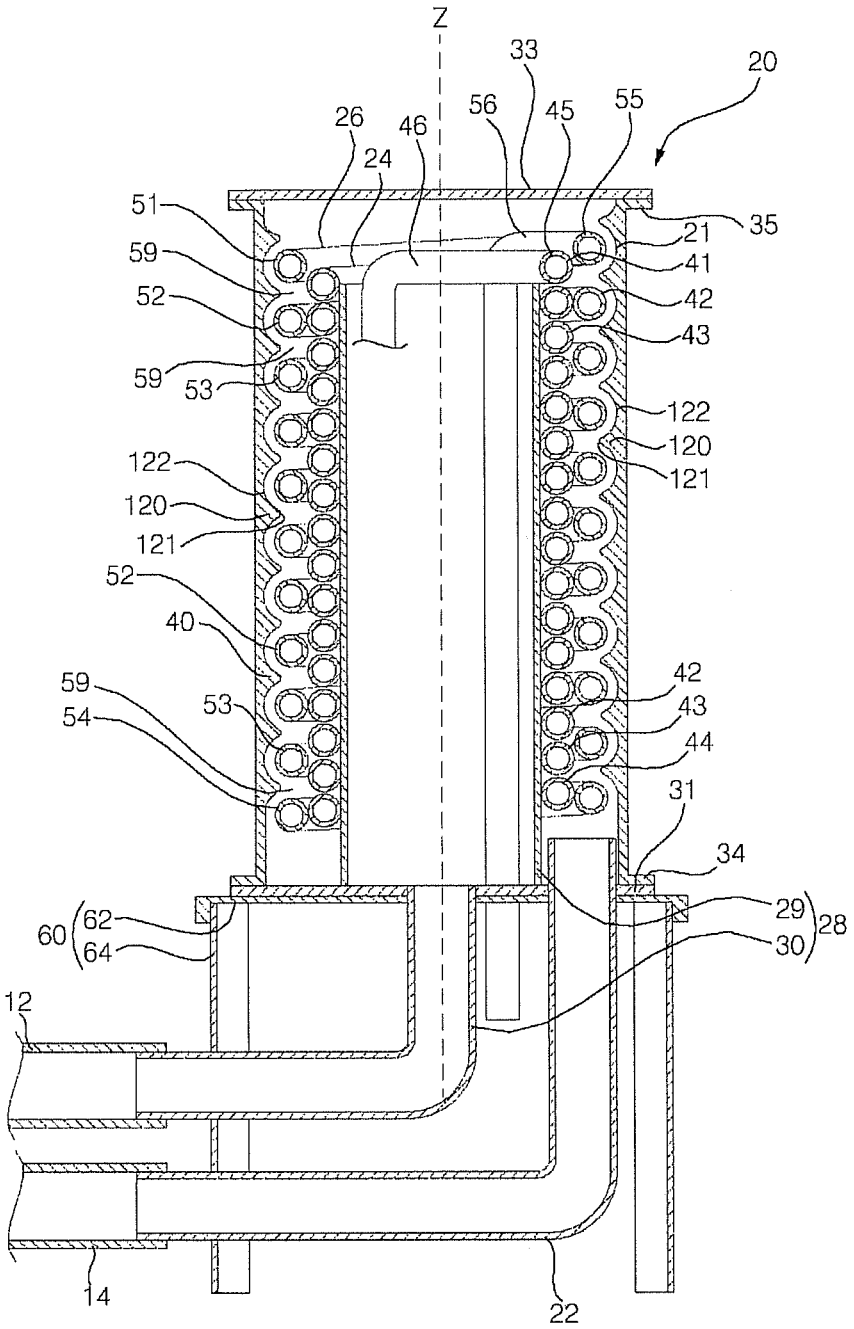
FIG. 21 is a schematic longitudinal cross-sectional view of a heat exchanger according to another embodiment.

FIG. 21 is a schematic longitudinal cross-sectional view of a heat exchanger according to another embodiment. In this embodiment, as shown in FIG. 21, a heat source fluid guide 120 may be formed in the shell 20, the heat source fluid guide 120 guiding the heat source fluid to the refrigerant tube 26. As the configuration and operation other than the heat source fluid guide 120 may be equal to or similar to the previous embodiment, repetitive detailed description has been omitted.

The heat source fluid guide 120 may be formed on the inner circumferential surface 21 of the shell 20. The heat source fluid guide 120 may be formed in the hollow shell 32, and may be formed on the inner circumferential surface 21 of the hollow shell 32. The heat source fluid guide 120 may be configured such that the discharge of the heat source fluid without heat-exchanging may be minimized by guiding the heat source fluid introduced into the inside of the shell 20 through the injection pipe 22 to the spiral tube portion 55 of the refrigerant tube 26. The heat source fluid guide 120 may protrude toward the gap 59 of the spiral tube portion 55. The heat source fluid guide 120 may protrude from the inner circumferential surface 21 of the hollow shell toward the gap 59 of the refrigerant tube 26. The heat source fluid may be induced to the gap 59 by the heat source fluid guide 120, and the heat source fluid induced to the gap 59 may be heat-exchanged with the lower portion of the turn 52 located on the upper side of the gap 59 and the upper portion of the turn 53 located on the upper side of the gap 59 using a wider heat transfer area. The heat source fluid guide 120 may be spirally vertically-formed on the inner circumferential surface 21 of the shell 20. The heat source fluid guide 120 may be configured such that a portion 121 is inserted into the gap 59. The heat source fluid guide 120 may have a curved surface 122 of a shape surrounding a portion of the turn.

For convenience, although FIG. 21 shows a plurality of refrigerant tubes 24 and 26, embodiments are not so limited. That is, a single refrigerant tube 26 may be installed in the shell 20, two refrigerant tubes may be installed in one shell 20, or three or four refrigerant tubes may be installed in one shell 20, for example. As described with respect to the first embodiment, the plurality of refrigerant tubes 24 and 26 may include the first refrigerant tube 24 and the second refrigerant tube 26, and the heat source fluid guide 120 may protrude toward the gap 59 formed on the second spiral tube portion 55 of the second refrigerant tube 26.

In the heat exchanger according to this embodiment, the heat source fluid introduced inside of the shell 20 from the injection pipe 22 may be guided to the heat source fluid guide 120 to pass through the gap 59 formed in the spiral tube portion 55 of the second refrigerant tube 26. In addition, the heat source fluid passing through the gap 59 may contact with the spiral tube portion 45 of the first refrigerant tube 24 at a location between the gap 59 and the discharge pipe 28, and may be heat-exchanged with the spiral tube portion 45 of the first refrigerant tube 24. The heat source fluid may be guided to the heat source fluid guide 120 between the spiral tube portion 45 of the first refrigerant tube 24 and the inner circumferential surface 21 of the shell 20 and may be elevated while rotating and flowing spirally. The heat source fluid may be heat-exchanged with the first refrigerant tube 24 and the second refrigerant tube 26, respectively, using a maximally wider contact area, while rotating and flowing spirally. The heat source fluid heat-exchanged with the first refrigerant tube 24 and the second refrigerant tube 26 may introduced into the discharge pipe 28 from the upper portion of the inner space SS of the shell 20 after being elevated to the upper portion of the inner space SS of the shell 20, and may flow to the outside of the shell 20 through the discharge pipe 28.

Embodiments disclosed herein provide a heat exchanger having a simple structure and improved heat-exchange performance. Further, embodiments disclosed herein provide a compact heat exchanger.

Embodiments disclosed herein provide a heat exchanger that may include a shell, a water injection pipe or injection pipe to guide a heat source fluid, such as water, to an inside of the shell, a first refrigerant tube formed with a first spiral tube portion, a second refrigerant tube formed with a second spiral tube portion having a radius larger than a radius of the first spiral tube portion, and a water discharge pipe or discharge pipe to which the heat source water heat-exchanged with a refrigerant may be discharged. The first refrigerant tube and the second refrigerant tube may be connected in parallel. The second spiral tube portion may have a larger pitch between turns and a smaller number of turns than those of the first spiral tube portion.

A number of turns of the second spiral tube portion may be determined by Equation 1 below:

$$N2=N1\times R1/R2 \quad \text{[Equation 1]}$$

where, N2 is the number of turns of the second spiral tube portion, N1 is a number of turns of the first spiral tube portion, R1 is a radius of the first spiral tube portion, and R2 is a radius of the second spiral tube portion.

The pitch between turns of the second spiral tube portion may be determined by Equation 2 below:

$$P2=P1\times N1/N2 \quad \text{[Equation 2]}$$

where, P2 is the pitch between turns of the second spiral tube portion, and P1 is the pitch between turns of the first spiral tube portion. The pitch between turns of the second spiral tube portion may be approximately 1.3 to 1.5 times the pitch between turns of the first spiral tube portion.

The second spiral tube portion may be disposed between the first spiral tube portion and the shell. The first spiral tube portion and the second spiral tube portion may be long-disposed inside of the shell in an up and down direction or vertically disposed within the shell. A vertical center axis or central vertical axis of the first spiral tube portion may correspond with a vertical center axis or central vertical axis of the second spiral tube portion.

At least one of the first spiral tube portion or the second spiral tube portion may have at least one protruding fin.

The water injection pipe may distribute and introduce the heat source water into the inside of the shell. A plurality of water injection pipes may be disposed to be separated from each other, and the heat source water may be guided to a plurality of locations in the inside of the shell. The water discharge pipe may include an inner water discharge pipe located on the inside of the shell, and an outer water discharge pipe to which the heat source water in the inner water discharge pipe is discharged and guided and which has a flow path cross-sectional area smaller than a flow path cross-sectional area of the inner water discharge pipe The first spiral tube portion may be located between the inner water discharge pipe and an inner peripheral surface of the shell. The second spiral tube portion may be disposed between the first spiral tube portion and the inner peripheral surface of the shell.

The first refrigerant tube may include a shell penetration portion that extends from one side of the first spiral tube portion and penetrates the inner water discharge pipe. Any one of the shell penetration portion of the first refrigerant tube or the shell penetration portion of the second refrigerant tube may be formed with a straight pipe portion, and the other one of the shell penetration portion of the first refrigerant tube or the shell penetration portion of the second refrigerant tube may be formed with a third spiral tube portion located between the outer peripheral surface of the straight pipe portion and the inner peripheral surface of the inner water discharge pipe and spirally wound.

The shell further may include a lower plate, a hollow shell disposed on an upper side of the lower plate, and an upper plate disposed on an upper side of the hollow shell. The water injection pipe may be disposed on the lower plate, and the water injection pipe may have an outlet that obliquely faces an inner peripheral surface of the hollow shell. The shell may be formed with a heat source water guide that protrudes to a gap of the second spiral tube portion.

Embodiments disclosed herein provide at least the following advantages.

As the first refrigerant tube and the second refrigerant tube may have the same flow path or a difference in the flow paths may be minimized, it is possible to prevent performance degradation that may occur when the first refrigerant tube and the second refrigerant tube have different flow paths, using a simple structure.

Embodiments disclosed herein further provide a compact heat exchanger as even if a flow path area or length of the refrigerant tube is larger, the shell penetration tube portion of the refrigerant tube may pass through the inside of the inner water discharge pipe.

Embodiments disclosed herein provide a heat exchanger having increased heat-exchange performance as the heat source water passing through the inner water discharge pipe may be heat-exchanged with the refrigerant additionally.

Embodiments disclosed herein provide a heat exchanger, in which heat-exchange performance may be maximized, as the heat source water introduced into the inner water discharge pipe may be heat-exchanged with the refrigerant while spirally rotating and flowing to the inside of the inner water discharge pipe.

Embodiments disclosed herein provide a heat exchanger having increased heat-exchange performance as the heat source water introduced into the inside of the shell through the water injection pipe may accelerate the rotation flow while turning along the inner peripheral surface of the hollow shell.

Embodiments disclosed herein provide a heat exchanger in which heat transfer time and heat transfer area may be maximized, as the heat source water may be heat-exchanged with the spiral tube portion while spirally rotating and flowing.

Embodiments disclosed herein provide a heat exchanger having increase heat-exchange performance using simple structure in which the water injection pipe is configured as an inclined pipe or a bent pipe, without installing a separate baffle to determine or control a flow direction of the heat source water.

Embodiments disclosed herein provide a heat exchanger in which the heat source water may be induced into a gap of the spiral tube portion by a heat source water guide that protrudes from the shell, such that the heat source water may be maximally heat-exchanged with the spiral tube portion and then may be discharged, without installing a separate baffle to induce the heat source water flow, by a simple structure.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A heat exchanger, comprising:

a shell;

at least one injection pipe to guide a heat source fluid to an inside of the shell;

a first refrigerant tube comprising a first spiral tube;

a second refrigerant tube comprising a second spiral tube having a radius larger than a radius of the first spiral tube, each radius being measured from a center of the respective spiral; and a discharge pipe to which the heat source fluid heat-exchanged with a refrigerant is discharged, wherein the first refrigerant tube and the second refrigerant tube are connected in parallel, and the second spiral tube portion has a larger pitch between turns and a smaller number of turns than the first spiral tube, wherein the number of turns of the second spiral tube is determined by the following equation below $$N2=N1\times R1/R2$$

where, N2 is the number of turns of the second spiral tube, N1 is a number of turns of the first spiral tube, R1 is a radius of the first spiral tube, and R2 is a radius of the second spiral tube.

2. The heat exchanger of claim 1, wherein the pitch between turns of the second spiral tube is determined by the following equation:

$$P2=P1\times N1/N2$$

where, P2 is the pitch between turns of the second spiral tube, and P1 is a pitch between turns of the first spiral tube.

3. The heat exchanger of claim 1, wherein a pitch between turns of the second spiral tube is approximately 1.3 to 1.5 times a pitch between turns of the first spiral tube.

4. The heat exchanger of claim 1, wherein the second spiral tube is disposed between the first spiral tube and the shell.

5. The heat exchanger of claim 1, wherein the first spiral tube and the second spiral tube extend inside of the shell in a substantially vertical direction.

6. The heat exchanger of claim 1, wherein a central vertical axis of the first spiral tube corresponds with a central vertical axis of the second spiral tube.

7. The heat exchanger of claim 1, wherein at least one of the first spiral tube or the second spiral tube comprises at least one protruding fin.

8. The heat exchanger of claim 1, wherein the at least one injection pipe distributes and introduces the heat source fluid into the inside of the shell.

9. The heat exchanger of claim 1, wherein the at least one injection pipe comprises a plurality of injection pipes disposed to be separated from each other, and the heat source fluid is guided to a plurality of locations in the inside of the shell by the plurality of injection pipes.

10. The heat exchanger of claim 1, wherein the discharge pipe includes an inner discharge pipe located inside of the shell, and an outer discharge pipe located outside of the shell to which the heat source fluid in the inner discharge pipe is discharged and guided.

11. The heat exchanger of claim 10, wherein the outer discharge pipe has a flow path cross-sectional area smaller than a flow path cross-sectional area of the inner discharge pipe.

12. The heat exchanger of claim 10, wherein the first spiral tube is located between the inner discharge pipe and an inner circumferential surface of the shell, and wherein the second spiral tube is disposed between the first spiral tube and the inner circumferential surface of the shell.

13. The heat exchanger of claim 10, wherein a portion of the first refrigerant tube extends from one end of the first spiral tube and penetrates the inner discharge pipe, and a portion of the second refrigerant tube extends from one end of the second spiral tube and penetrates the inner discharge pipe.

14. The heat exchanger of claim 13, wherein one of the portion of the first refrigerant tube or the portion of the second refrigerant tube comprises a straight pipe, and the other one of the portion of the first refrigerant tube or the portion of the second refrigerant tube comprises a third spiral tube located between an outer circumferential surface of the straight pipe and an inner circumferential surface of the inner discharge pipe.

15. The heat exchanger of claim 1, wherein the shell further includes a lower plate, a hollow shell disposed on an upper side of the lower plate, and an upper plate disposed on an upper side of the hollow shell.

16. The heat exchanger of claim 15, wherein the at least one injection pipe is disposed on the lower plate, and wherein an outlet of the at least one injection pipe obliquely faces an inner circumferential surface of the hollow shell.

17. The heat exchanger of claim 1, wherein the shell comprises a heat source fluid guide that protrudes into a gap of the second spiral tube.

18. An air conditioner comprising the heat exchanger of claim 1.

19. A heat exchanger, comprising:

a shell;

at least one refrigerant tube having a spiral tube located inside of the shell and first and second shell penetration tubes that penetrate the shell;

at least one injection pipe that injects and guides a heat source fluid to the inside of the shell;

an inner discharge pipe located on the inside of the shell; and an outer discharge pipe to which the heat source fluid in the inner fluid discharge pipe is discharged, wherein any one of the first and second shell penetration tubes of the at least one refrigerant tube passes through the inner discharge pipe, wherein one of the first shell penetration tube or the second shell penetration tube passes between the inner discharge pipe and the shell, wherein the shell includes a discharge pipe connection hole to which the outer discharge pipe is connected, a first penetration hole through which one of the first and second shell penetration tubes penetrates, the one of the first and second shell penetration tubes penetrating the inner discharge pipe, and a second penetration hole through which the other of the first and second shell penetration tubes penetrates, the other of the first and second shell penetration tube passing between the inner discharge pipe and the shell, and wherein a cross-sectional area of a flow path of the inner discharge pipe is larger than a sum of an area of the discharge pipe connection hole and an area of the first penetration hole.

20. The heat exchanger of claim 19, wherein the inner discharge pipe has a cross-sectional area having a flow path larger than a cross-sectional area of a flow path of the outer discharge pipe.

21. The heat exchanger of claim 19, wherein an output end of the inner discharge pipe is coupled with the shell.

22. The heat exchanger of claim 19, wherein the discharge pipe connection hole and the first penetration hole are each formed at locations that face an inner space of the inner discharge pipe, and wherein the second penetration hole is formed at a location that faces an area between the inner discharge pipe and the shell.

23. The heat exchanger of claim 19, wherein one of the first and second shell penetration tubes, which penetrates the inner discharge pipe, includes a spiral tube.

24. The heat exchanger of claim 19, wherein the at least one refrigerant tube comprises a plurality of refrigerant tubes, wherein any one of the plurality of refrigerant tubes includes a straight pipe that penetrates the inner discharge pipe, and the another one of the plurality of refrigerant tubes includes a spiral tube that penetrates the inner discharge pipe.

25. The heat exchanger of claim 24, wherein the spiral tube is disposed between an outer circumferential surface of the straight pipe and an inner circumferential surface of the inner discharge pipe.

26. The heat exchanger of claim 19, wherein the shell comprises a heat source fluid guide that protrudes into a gap of the spiral tube.

27. An air conditioner comprising the heat exchanger of claim 19.

* * * * *